United States Patent [19]

Aono et al.

[11] Patent Number: 4,500,624

[45] Date of Patent: Feb. 19, 1985

[54] HEAT-DEVELOPABLE DIFFUSION TRANSFER COLOR PHOTOGRAPHIC MATERIAL WITH MICROCAPSULES

[75] Inventors: Toshiaki Aono; Hiroshi Hara; Hideki Naito, all of Kanagawa, Japan

[73] Assignee: Fuji Photo Film Co., Ltd., Kanagawa, Japan

[21] Appl. No.: 483,063

[22] Filed: Apr. 7, 1983

[30] Foreign Application Priority Data

Apr. 7, 1982 [JP] Japan ..... 57-57781

[51] Int. Cl.[3] ..... G03C 5/54; G03C 1/40

[52] U.S. Cl. ..... 430/138; 430/203

[58] Field of Search ..... 430/203, 351, 138

[56] References Cited

U.S. PATENT DOCUMENTS

| | | | |
|---|---|---|---|
| 4,021,240 | 5/1977 | Cerquone et al. | 430/617 |
| 4,022,617 | 5/1977 | McGuckin | 430/203 |
| 4,124,387 | 11/1978 | Kohrt | 430/203 |
| 4,235,957 | 11/1980 | Kohrt et al. | 430/203 |

*Primary Examiner*—Richard L. Schilling

*Attorney, Agent, or Firm*—Sughrue, Mion, Zinn, Macpeak, and Seas

[57] ABSTRACT

A heat-developable diffusion transfer color photographic material is disclosed. The material is comprised of a heat-developable color photographic element containing at least a light-sensitive silver halide, an organic silver salt oxidizing agent and a color image forming substance and an image receiving element capable of accepting a dye which is formed or released in the heat-developable color photographic element, the heat-developable color photographic element and the image receiving element being provided on the same support or being provided on different supports respectively, and either one of these elements or both of these elements contain a microcapsule comprising a water-immiscible compound which is liquid at a temperature of not less than 120° C. as a core material and a water-insoluble polymer wall.

The heat-developable diffusion transfer color photographic material contains a diffusion accelerator for the dye in the microcapsule and can easily provide a transferred color image without adversely affecting the coating property and physical property of the light-sensitive element.

A process for forming a color image using the heat-developable diffusion transfer color photographic material is also disclosed.

64 Claims, No Drawings

HEAT-DEVELOPABLE DIFFUSION TRANSFER COLOR PHOTOGRAPHIC MATERIAL WITH MICROCAPSULES

FIELD OF THE INVENTION

The present invention relates to a novel heat-developable diffusion transfer color photographic material which can provide a color image by the transfer of a dye which is formed or released upon heat development after imagewise exposure. In particular, the present invention relates to a novel heat-developable diffusion transfer color photographic material containing a microcapsule of a water-immiscible compound.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In the recent years, with respect to image formation processes for photographic materials using silver halide, many techniques capable of easily and rapidly obtaining images have been developed by changing the conventional wet process using a developing solution into a dye process such as a process using heat, etc.

Heat-developable photographic materials are known in the field of these techniques, and heat-developable photographic materials and processes have been described in U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and the combination of a sulfonamidophenol type reducing agent and a 4-equivalent coupler as described in U.S. Pat. No. 4,021,240.

Also, processes for forming a positive color image by a heat developable silver dye bleach process, with useful dyes and methods for bleaching have been described, for example, in *Research Disclosure,* No. 14433, pages 30 to 32 (April, 1976), ibid., No. 15227, pages 14 and 15 (Dec., 1976) and U.S. Pat. No. 4,235,957.

Moreover, a process for forming a color image utilizing a leuco dye has been described, for example, in U.S. Pat. Nos. 3,985,565 and 4,022,617.

However, these various processes for forming a color image by heat development are undesirable because discoloration and/or fading of the color image or coloration of the white background portion, etc., occurs because developed silver, the remaining silver salt and the remaining developing agent are coexistent after the heat development procedure. To eliminate this disadvantage, there has been proposed a process which comprises transferring the resulting color image to an image receiving sheet in the presence of a solvent such as methanol, etc., as described in U.S. Pat. Nos. 3,531,286, 3,761,270 and 4,021,240, etc. However, this process is not desirable from a standpoint of easy and rapid processing because of the increase in complicated steps.

With respect to processes for forming color images, the method using a compound capable of releasing a diffusible dye upon the coupling reaction with an oxidized product of an aromatic primary amine is described in Japanese Patent Application (OPI) Nos. 186744/82 and 207250/82.

Also, the method using a dye providing reducing compound capable of releasing a diffusible dye when oxidized is described in Japanese Patent Application (OPI) Nos. 179840/82 and 198458/82.

In these heat-developable color image forming methods, however, it is necessary to diffusion transfer the dyes released upon heat development into an image receiving element, in order to observe the color image formed. In a method for transferring the diffusible dye, which is described in these publications referred to above a surface of a photographic element or an image receiving element is wet with an organic solvent such as methanol, etc. or an oil and then both elements are superposed on each other whereby diffusion transfer is carried out. However, such a method is also undesirable in view of simplicity and quickness.

A method for omitting the dye diffusion transfer step involves incorporating a thermal solvent into the heat-developable color photographic material as described in Japanese Patent Application (OPI) Nos. 198458/82 and 179840/82. In these publications, there are described, as diffusion accelerators, some examples of non-hydrolizable organic compounds which are solid at room temperature (about 25° C.) but become liquid at the time of heat development, that is thermal solvents. However, this method is disadvantageous since the coating property and film quality of the photographic material is degraded when such compounds are incorporated into the photographic material in an amount sufficient for conducting the diffusion transfer of dyes. Further, organic compounds which are liquid at room temperature exhibit a large effect on accelerating the diffusion transfer of dyes in comparison with organic compounds which are solid at room temperature, however, the former seriously degrade the coating property and film quality when they are incorporated into the photographic material.

SUMMARY OF THE INVENTION

The present invention provides a novel heat-developable diffusion transfer color photographic material eliminating the drawbacks of heretofore known photographic materials and a method for producing the material.

Therefore, an object of the present invention is to provide a heat-developable diffusion transfer color photographic material having a novel structure which does not form color fog even if it is preserved for a long period of time.

Another object of the present invention is to provide a heat-developable diffusion transfer color photographic material having excellent transferability.

Still another object of the present invention is to provide a method for obtaining a clear color image by means of a simple and rapid heat treatment.

A further object of the present invention is to provide a method for incorporating a diffusion accelerator into a photographic material without the degradation of coating property and film quality of the photographic material.

A still further object of the present invention is to provide a method for incorporating a compound which has an excellent property for transferring a dye and is liquid at room temperature into a photographic material as a diffusion accelerator without adversely affecting the coating property, photographic properties and film quality of the photographic material.

These and other objects of the present invention will become more apparent from the following detailed description and examples.

These objects of the present invention are attained by a heat-developable diffusion transfer color photographic material comprising a heat-developable color photographic element containing at least a light-sensitive silver halide, an organic silver salt oxidizing agent and a color image forming substance and an image receiving element capable of accepting a dye which is formed or released in the heat-developable color photographic element, the heat-developable color photographic element and the image receiving element being provided on the same support or being provided on different supports respectively, and either one of these elements or both of these elements containing a microcapsule comprising a water-immiscible compound which is liquid at a temperature of not less than 120° C. as a core material and a water-insoluble polymer wall.

DETAILED DESCRIPTION OF THE INVENTION

The term "water-immiscible compound" used herein means a compound which can not be completely mixed with water and the whole mixture is separated into two phases, i.e., a phase mainly composed of water and a phase mainly composed of the compound, when the compound is admixed with water.

The heat-developable diffusion transfer color photographic material used in the present invention comprises a heat-development color photographic element (I) which contains at least light-sensitive silver halide, an organic silver salt oxidizing agent and a color image forming substance and an image receiving element (II) which is capable of accepting a diffusible dye which is formed or released in the heat-developable color photographic element (I).

The above described photographic element (I) and the image receiving element (II) may be formed on the same support, or they may be formed on different supports, respectively. The image receiving element (II) may be peeled apart from the photographic element (I). Further, after the photographic element (I) is exposed imagewise to light, the photographic element (I) can be subjected to development and diffusion transfer with heating by superposing the image receiving element (II) on the photographic element (I). Furthermore, after the photographic element (I) is exposed imagewise to light and developed with heating, the dye formed can be transferred to the image receiving element (II) by superposing the image receiving element (II) thereon and heating to a temperature lower than the developing temperature.

The image receiving element (II) may comprise a layer of a dye acceptable organic polymer applied to a support or a support of a polymer film per se which is capable of accepting a dye.

The heat-developable diffusion transfer color photographic material of the present invention can provide a imagewise developed silver and simultaneously a diffusible dye formed or released on the part corresponding to the silver image by carrying out heat development after imagewise exposure to light. In this step, a water-immiscible organic solvent or a compound which is liquid at a temperature of not less than 120° C. (hereinafter referred to as "a water-immiscible diffusion accelerator") which is retained in a microcapsule is supplied into a binder by means of transmission through the capsule wall or melting or rupture of the capsule wall by heating and, as a result diffusion of the diffusible dye formed or released into the image receiving element is accelerated.

The water-immiscible diffusion accelerator incorporated into a microcapsule which can be used in the present invention can be an organic solvent having a high boiling point of not less than 200° C. or an organic solvent having a low boiling point of less than 200° C.

Examples of the organic solvents having a high boiling point include a phthalic acid alkyl ester (e.g., dibutyl pthalate, dioctyl phthalate, dicyclohexyl phthalate, diphenyl phthalate, etc.), a phosphoric acid ester (e.g., diphenyl phosphate, triphenyl phosphate, tricresyl phosphate, dioctylbutyl phosphate, tricyclohexyl phosphate, etc.), a citric acid ester (e.g., tributyl acetylcitrate, etc.), an alkyl amide (e.g., diethyl laurylamide, etc.), a fatty acid ester (e.g., dibutoxyethyl succinate, dioctyl azelate, etc.), a trimesic acid ester (e.g., tributyl trimesate, etc.), and the like. Further, the plasticizer as described in K. Doolittle, *The Technology of Solvents and Plasticizers,* pages 903 to 927, John Wirley & Sons, Inc., New York (1954) can be employed.

Examples of the organic solvents having a low boiling point include a lower alkyl ester (e.g., ethyl acetate, ethyl propionate, β-ethoxyethyl acetate, methyl Cellosolve acetate, n-amyl acetate, butyl propionate, etc.), a hydrocarbon (e.g., cyclohexane, hexane, heptane, benzene, toluene, xylene, etc.), a substituted hydrocarbon (e.g., chloroform, carbon tetrachloride, dichloromethane, etc.), a hydroxy compound (e.g., n-amyl alcohol, isoamyl alcohol, 1-hexanol, cyclohexanol, etc.), an ether (e.g., n-propyl ether, isopropyl ether, n-butyl ether, etc.), a ketone (e.g., cyclohexanone, diisopropyl ketone, etc.), a nitrogen compound (e.g., diamylamine, etc.), and the like.

It is preferred that an organic solvent having a low boiling point of from 50° C. to 180° C. and preferably from 80° C. to 160° C. is contained in the above described organic solvent having a high boiling point. The organic solvent having a low boiling point retained in a microcapsule is easily supplied in a binder by transmission through the capsule wall by heating. However it also has a tendency to evaporate during preservation of coated samples. On the contrary, the evaporation of the organic solvent having a low boiling point during preservation is repressed when it is used as a mixture with the organic solvent having a high boiling point. The organic solvent having a low boiling point and the organic solvent having a high boiling point can be used in any rate of mixture, but it is preferred that the organic solvent having a low boiling point is employed in an amount of not more than 50% by weight of the organic solvent having a high boiling point.

Examples of processes for producing microcapsules retaining a water-immiscible diffusion accelerator used in the present invention include conventional processes, for example, a phase separation method in which a concentrated phase of polymer (coacervate) is phase-separated from an aqueous solution of a water-soluble polymer whereby a capsule wall is formed (as described in U.S. Pat. Nos. 2,800,457 and 2,800,458, etc.), an interfacial polymerization method in which on the interface of two liquid which are immiscible each other reactants previously added separatedly to each liquid are subjected to condensation polymerization and a polymer film which is insoluble in both of the liquids in formed on the interface whereby a capsule wall is formed (as described in Japanese Patent Publication Nos. 19574/63, 446/67, 771/67, 2882/67, 2883/67, 8693/67, 9654/67, 11344/67, Japanese Patent Application (OPI) 9097/76, U.S. Pat. No. 3,287,154, British Pat. Nos. 950,443 and 1,046,409, etc.), a method for polymerization of a wall material in oil droplets (as described in Japanese Patent Publication Nos. 9168/61, 45133/74, etc.), a melting, dispersing and cooling method using a substance which is solid at ordinary room temperature and is liquidified by heating as a wall material (as described in British Pat. Nos. 952,807 and 965,074, etc.), a method by deposition of a polymer (as described in U.S. Pat. Nos. 3,418,250 and 3,660,304, Japanese Patent Publication No. 23165/72, etc.), a polymerization method in which reactants are supplied from the inside of oil droplets (as described in U.S. Pat. Nos. 3,726,804 and 3,796,669, etc.), and the like.

The size of the microcapsules used in the present invention is not limited, but a size of from 1 μm to 50 μm is preferable.

The microcapsules retaining the water-immiscible diffusion accelerator which can be used in the present invention may be incorporated either into the photographic element (I) or into the image receiving element (II). More specifically, they may be incorporated into one or more layers selected from an undermost layer, an uppermost layer, an emulsion layer, an intermediate layer positioned between one emulsion layer and the other emulsion layer of the photographic element (I) or an image receiving layer, a layer positioned over or under the image receiving layer of the image receiving element (II), etc.

Microcapsules retaining the water-immiscible diffusion accelerator to be incorporated into the color photographic material are present in an amount within a range from 0.1 g/m$^2$ to 100 g/m$^2$, and preferably, from 1 g/m$^2$ to 30 g/m$^2$ calculated as an amount of the diffusion accelerator.

The heat-developable color photographic material of the present invention can provide a silver image corresponding to the object and a color image due to the formation or bleaching of dyes on the part corresponding to the silver image by carrying out heat development at a temperature range from 80° C. to 250° C., and preferably, from 120° C. to 190° C., after imagewise exposure to light. The formation or bleaching of dyes is performed in a different process depending on the kind of the color image forming substance and includes, for example, the following processes:

(1) formation of a dye by bonding of an oxidized product of a reducing agent which is formed upon the oxidation-reduction reaction between an organic silver salt oxidizing agent and a reducing agent with a coupler.

(2) releasing of a diffusible dye by the reaction of a coupler having a diffusible dye as a releasable group with the oxidized product described above.

(3) releasing of a diffusible dye by the oxidation-reduction reaction between an organic silver salt oxidizing agent and a dye releasing reducing compound and the subsequent attack with a nucleophilic agent.

(4) releasing of a diffusible dye by the oxidation-reduction reaction between a silver salt of silver salt forming dye and a reducing agent.

(5) formation of a dye by the oxidation-reduction reaction between a leuco body of a dye or a precursor thereof and an organic silver salt oxidizing agent.

(6) bleaching of a cye with a metal silver.

The process of (1) is described, for example, in U.S. Pat. Nos. 3,531,286, 3,761,270 and 4,021,240, Belgian Pat. No. 802,519, *Research Disclosure,* Vol. 139, No. 13946.

The process of (2) is described, for example, in Japanese Patent Application (OPI) Nos. 186744/82 and 207250/82.

The process of (3) is described, for example, in Japanese Patent Application (OPI) Nos. 179840/82 and 198458/82.

The process of (4) is described, for example, in *Research Disclosure,* Vol. 169, No. 16966.

The process of (5) is described, for example, in U.S. Pat. Nos. 3,985,565 and 4,022,617.

The process of (6) is described, for example, in *Research Disclosure,* Vol. 144, No. 14433, ibid., Vol. 152, No. 15227, U.S. Pat. No. 4,235,957.

The process of (1) comprises forming a dye by the reaction of an oxidized product of a reducing agent which is formed upon the reaction of a reducing agent a typical example of which includes a p-aminophenol derivative or a p-phenylenediamine derivative with an organic silver salt oxidizing agent with a coupler, that is, a phenol, a naphthol, an active methylene compound or an active methine compound represented by the following general formulae (I) to (VI):

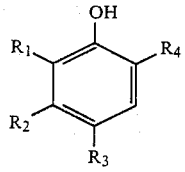

(I)

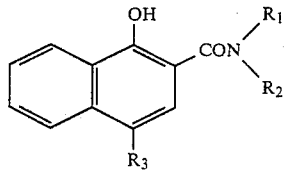

(II)

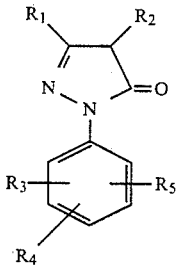

(III)

-continued

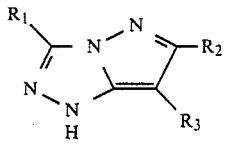

(IV)

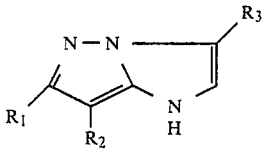

(V)

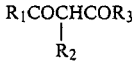

(VI)

wherein $R_1$, $R_2$, $R_3$, $R_4$ and $R_5$, which may be the same or different, each represents a hydrogen atom or a substituent selected from an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group, a cyano group, an alkylsulfonyloxy group, an arylsulfonyloxy group, an alkylsulfonylamino group, an arylsulfonylamino group, an alkylthio group, an arylthio group, an arylazo group, a heterocyclic residue, a group of

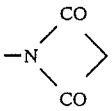

and a group of

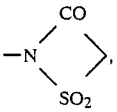

and these substituents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

The process of (2) comprises releasing a diffusible dye by the reaction of color image forming substance which has a releasable group containing the diffusible dye at the coupling position of a coupler and is represented by the general formula (VII) below with the above described oxidized product of the reducing agent and transferring the dye into an image receiving element.

C—L—D (VII)

wherein C represents a substratum capable of bonding to an oxidized product which is formed by a reaction between a reducing agent and an organic silver salt oxidizing agent; D represents a dye portion for forming a color image; and L represents a connecting group between C and D and the bond between C and L is cleaved upon the reaction of C with the oxidized product of the reducing agent.

The substratum represented by C is capable of bonding to an oxidized product which is formed by a reaction between a reducing agent and an organic silver salt oxidizing agent and includes an active methylene residue, an active methine residue, a phenol residue or a naphthol residue. Examples of the substrata are represented by the following general formulae (VIII) to (XIV):

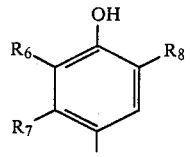

(VIII)

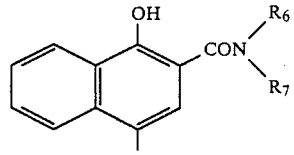

(IX)

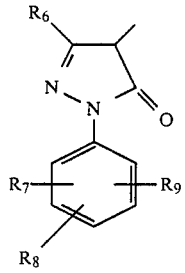

(X)

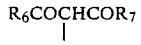

(XI)

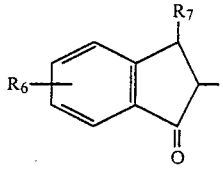

(XII)

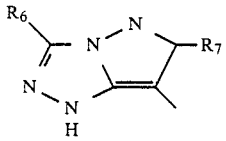

(XIII)

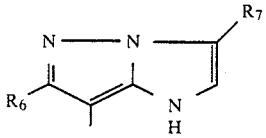

(XIV)

wherein $R_6$, $R_7$, $R_8$ and $R_9$, which may be the same or different, each represents a hydrogen atom or a substituent selected from an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and these substituents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

L represents a divalent residue connecting C and D with a covalent bond and having the total nomber of the carbon atoms contained of not more than 12, and D represents a color image forming dye.

The process of (3) comprises releasing a diffusible dye by the oxidation of a dye releasing reducing compound by the reaction of the dye releasing reducing compound which is a color image forming substance having a reducing property and is represented by the general formula (XV) below with an organic silver salt oxidizing agent and the subsequent action with a nucleophilic agent.

$$R—SO_2—D \qquad (XV)$$

wherein R represents a reducing substratum capable of being oxidized by an organic silver salt oxidizing agent, and D represents a dye portion for forming a color image.

Examples of the reducing substrata are represented by the following general formulae (XVI) to (XXIII):

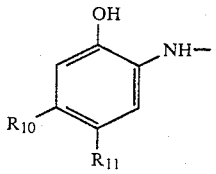
(XVI)

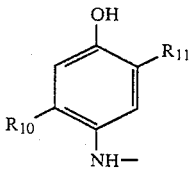
(XVII)

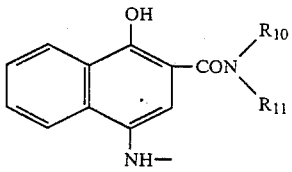
(XVIII)

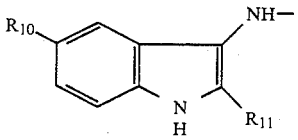
(XIX)

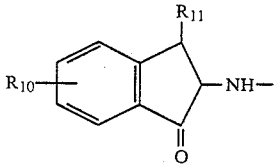
(XX)

-continued

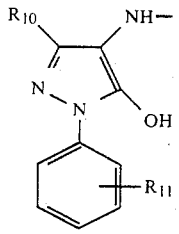
(XXI)

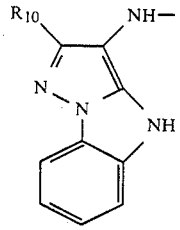
(XXII)

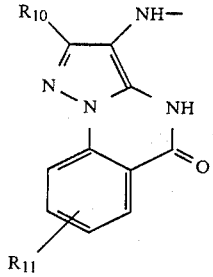
(XXIII)

wherein $R_{10}$ and $R_{11}$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group or an N-substituted sulfamoyl group, and these substituents may be further substituted with a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group.

The process of (4) utilizes the phenomenon in which a metal silver is released from a silver salt of silver salt forming dye by the oxidation-reduction reaction between the silver salt of silver salt forming dye represented by the general formula (XXIV) below and a reducing agent and the silver salt forming dye becomes diffusible. In this case, the silver salt of silver salt forming dye is not only an organic silver salt oxidizing agent but also a color image forming substance.

$$D—AH \qquad (XXIV)$$

wherein D represents a dye portion for forming a color image; and AH represents a group having a silver salt forming function.

Examples of AH include an aliphatic or aromatic carboxylic acid group, a sulfonic acid group, a phosphoric acid group, a mercapto group, a group of >NH, a phenolic hydroxy group, etc.

The process of (5) comprises oxidizing a leuco body to an original dye by the oxidation-reduction reaction between a leuco body (reduced form) of a dye capable of being reduced or a precursor thereof and an organic silver salt oxidizing agent to obtain a color image. Examples of the dye capable of being reduced include an azo dye, an azomethine dye, an anthraquinone dye, a naphthoquinone dye, a triarylmethane dye, a xanthene dye, an azine dye, an indigoid dye, a formazane dye, a nitro dye, a nitroso dye, an azoxy dye, etc. In the present invention, a leuco body of an azomethine dye, an anthraquinone dye, a naphthoquinone dye, a triarylmethane dye, a xanthene dye, an azine dye and an indigoid dye are particularly useful.

Further, the leuco body of the above described dye can be used as a precursor thereof. Where a leuco body is sensitive to oxidation and tends to be readily colored, it is particularly effective to use a method of stabilizing the leuco body as a precursor thereof. The most general method of stabilizing the leuco body is a method in which a group relevant to the color formation of the leuco dye such as a hydroxy group, an amino group, etc., is protected with a hydrolizable group by acylation, sulfonylation, phosphonylation, etc.

The process of (6) comprises bleaching a bleachable dye by the action of metal silver, a silver ion complex forming agent and an electron transferring agent in the presence of an acid. Examples of the bleachable dyes include an azo dye, an azoxy dye, an azomethine dye, a triarylmethane dye, a xanthene dye, an azine dye, an anthraquinone dye, a naphthoquinone dye, an indigoid dye, a nitro dye, a nitroso dye, a formazane dye, etc. In the present invention, an azo dye is particularly useful. Also, a precursor of an azo dye such as a hydrazo compound, a diazoamino compound, etc., is effective.

In the each process of the present invention, examples of color image forming dyes contained in the color image forming substance include an azo dye, an azomethine dye, an anthraquinone dye, a naphthoquinone dye, a nitro dye, a styryl dye, a quinophthalone dye, a triarylmethane dye, a phthalocyanine dye and a precursor thereof (for example, a leuco body, a temporary short-wave shifted body, etc.).

Characteristics required for the color image forming dye are as follows:

(1) It does not contain a group having a charge such as a group of $-SO_3^-$, a group of $-COO^-$ or a quaternary amino group, etc.

(2) It has a hue suitable for color reproduction.

(3) It has a large molecular extinction coefficient.

(4) It is stable to light, heat and other additives in the system, such as the reducing agent.

(5) It is easily synthesized.

Examples of the preferred color image forming dyes which satisfy the above described requirements are set forth below, but the present invention is not to be construed as being limited thereto.

Yellow:

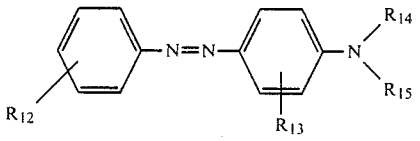

-continued

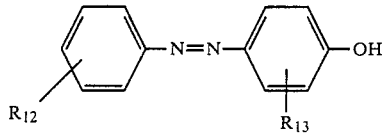

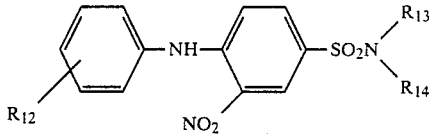

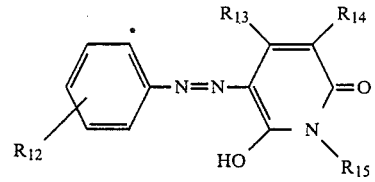

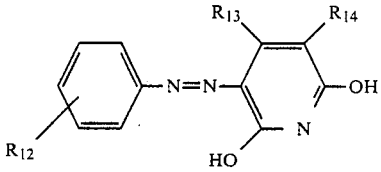

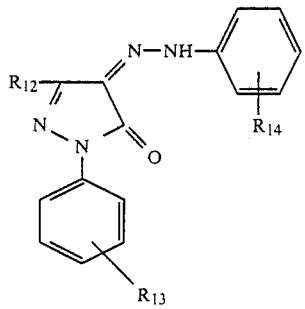

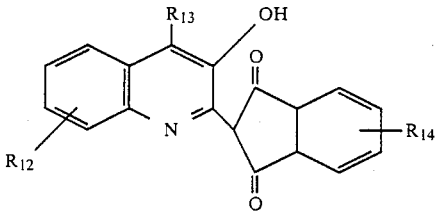

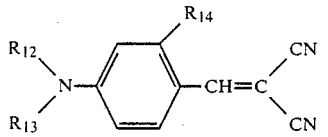

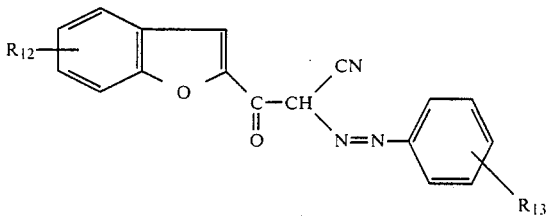

-continued
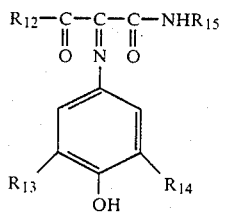
Magenta:
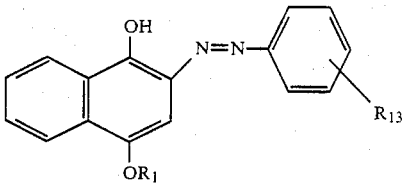
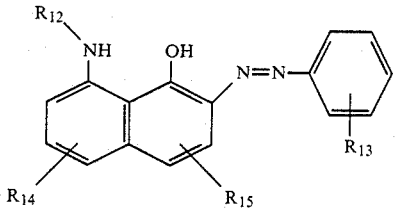
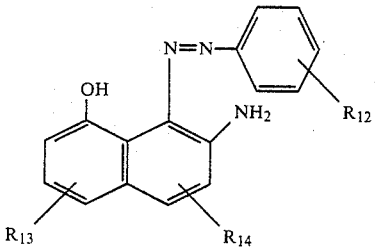
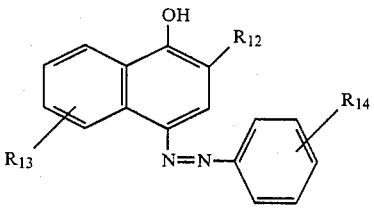
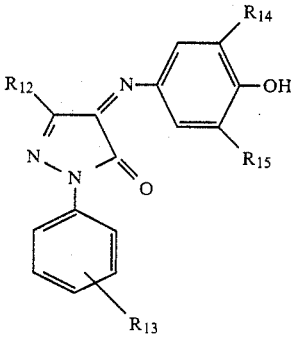
-continued
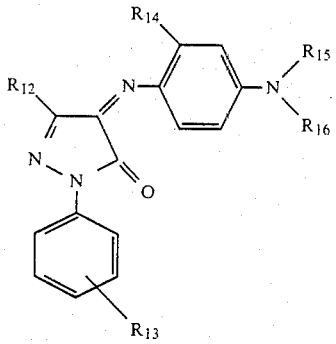
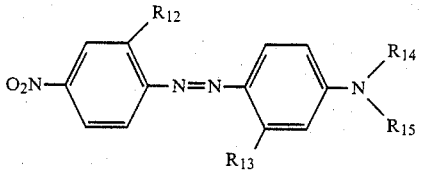
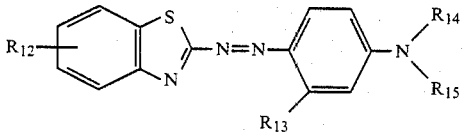
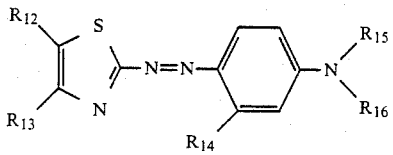
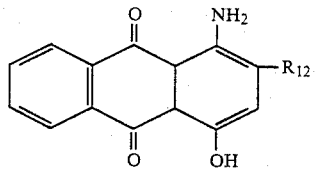
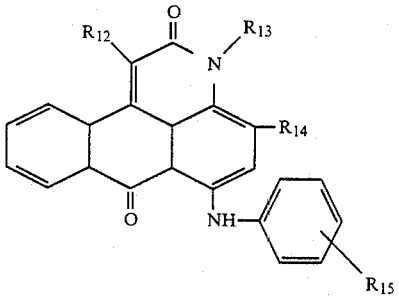
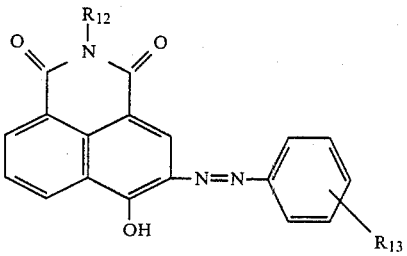
Cyan:

-continued

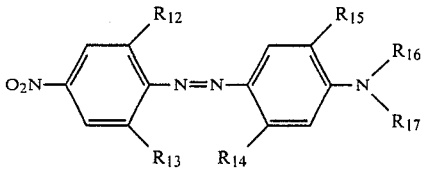

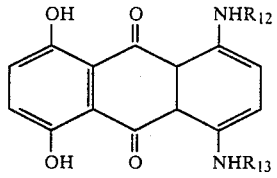

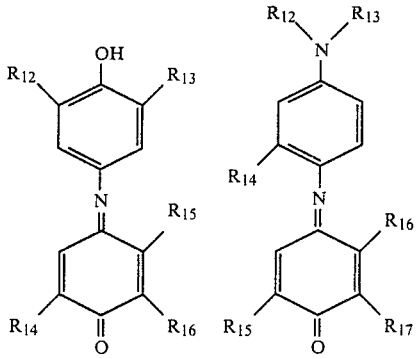

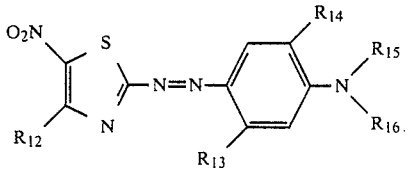

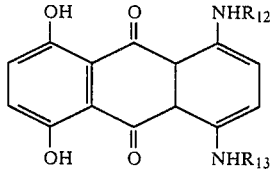

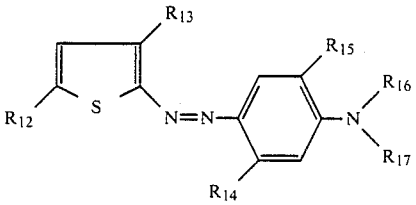

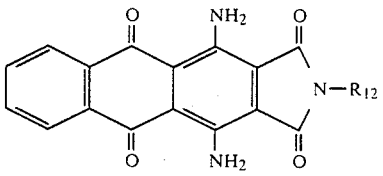

-continued

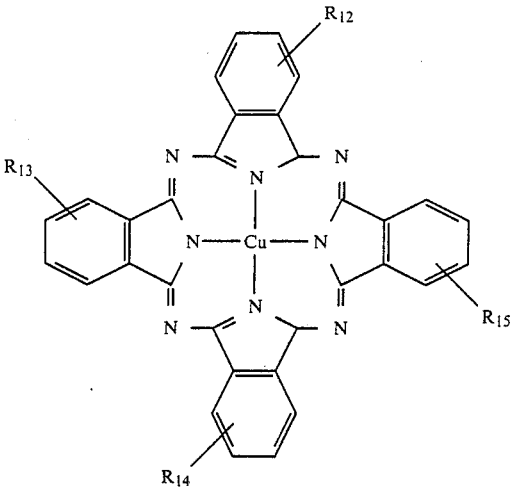

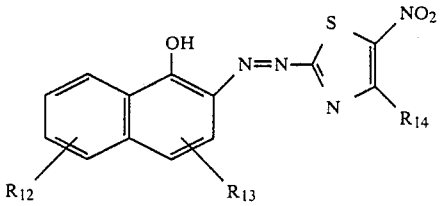

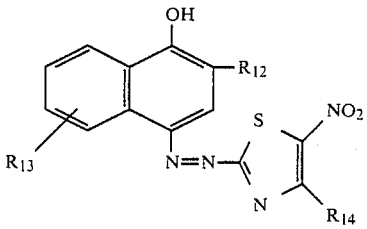

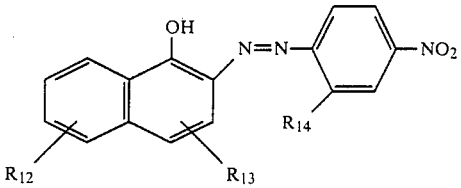

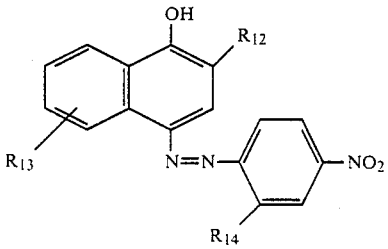

wherein $R_{12}$ to $R_{17}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group or an arylthio group.

The light-sensitive silver halide used in the present invention can be employed in a range from 0.005 mol to 5 mols and, preferably, from 0.005 mol to 1.0 mol per mol of the organic silver salt oxidizing agent.

Examples of silver halide include silver chloride, silver chlorobromide, silver chloroiodide, silver bromide, silver iodobromide, silver chloroiodobromide and silver iodide, etc.

The particle size of the silver halide used is from 0.001 μm, to 2 μm and, preferably, from 0.001 μm to 1 μm.

The silver halide used in the present invention may be employed as is, but it may be chemically sensitized with a chemical sensitizing agent such as a compound containing sulfur, selenium or tellurium, etc., or a compound containing gold, platinum, palladium, rhodium or iridium, etc., a reducing agent such as a tin halide, etc., or a combination thereof. The details of these procedures are described in T. H. James, *The Theory of the Photographic Process,* Fourth Edition, Chapter 5, pages 149 to 169.

The organic silver salt oxidizing agent which can be used in the present invention is a silver salt which is comparatively stable to light and which forms a silver image by reacting with the above described image forming substance or a reducing agent coexisting, if necessary, with the image forming substance, when it is heated to a temperature of above 80° C. and, preferably, above 100° C. in the presence of exposed silver halide.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxyl group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

In addition, a silver salt of a compound containing mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycolic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 3027/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., can be used instead of the organic metal salt oxidizing agent of the present invention.

The silver halide and the organic silver salt oxidizing agent which form a starting point of development should be present within a substantially effective distance.

For this purpose, it is desired that the silver halide and the organic silver salt oxidizing agent are present in the same layer.

The silver halide and the organic silver salt oxidizing agent which are separately formed in a hydrophilic binder can be mixed prior to use to prepare a coating solution, but it is also effective to blend both of them in a ball mill for a long period of time. Further, it is effective to use a process which comprises adding a halogen containing compound to the organic silver salt oxidizing agent prepared and forming silver halide using silver of the organic silver salt oxidizing agent and halogen of the halogen containing compound.

Methods of preparing these silver halide and organic silver salt oxidizing agent and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total from 50 $mg/m^2$ to 10 $g/m^2$ calculated as an amount of silver.

The light-sensitive silver halide and the organic silver salt oxidizing agent used in the present invention are prepared in the binder as described below. Further, the color image forming substance may be dispersed in the binder as described below.

The binder which can be used in the present invention can be employed individually or in a combination of two or more. Both of a hydrophilic polymer and hydrophobic polymer can be used as the binder according to the present invention. The typical hydrophilic binder is a transparent or translucent hydrophilic colloid, examples of which include a natural substance for example, protein such as gelatin, a gelatin derivative, a cellulose derivative, a polysaccharide such as starch, gum arabic, etc. and a synthetic polymer, for example, a water-soluble polyvinyl compound such as polyvinyl pyrrolidone, acrylamide polymer, etc. Another example of the synthetic polymer compound is a dispersed vinyl compound in a latex form which is particularly used for the purpose of increasing the dimensional stability of a photographic material.

The hydrophobic polymer binder which can be used in the present invention is a transparent synthetic polymer examples of which include those described in U.S. Pat. Nos. 3,142,586, 3,193,386, 3,062,674, 3,220,844, 3,287,289 and 3,411,911. Examples of the effective polymers include a water insoluble polymer composed of a monomer such as an alkyl acrylate, an alkyl methacrylate, acrylic acid, a sulfoalkyl acrylate or a sulfoalkyl methacrylate, etc. and a polymer having cyclic sulfobetaine unit as described in Canadian Pat. No. 774,054. Examples of preferred polymers include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, a butadiene-styrene copolymer, a vinyl chloride-vinyl acetate copolymer, a vinyl chloride-vinyl acetate-maleic acid copolymer, polyvinyl alcohol, polyvinyl acetate, benzyl cellulose, acetyl cellulose, cellulose propionate and cellulose acetate phthalate, etc. Among these polymers, polyvinyl butyral, polyvinyl acetate, ethyl cellulose, polymethyl methacrylate and cellulose acetate butyrate are particularly preferred to use. If necessary, two or more of them may be used as a mixture. The amount of the hydrophobic polymer binder is in a range of from about 1/10 to 10 times and, preferably, $\frac{1}{4}$ to 4 times by weight ratio based on the organic silver salt oxidizing agent.

It is desirable to use a packet emulsion in which the silver halide emulsion, the organic silver salt oxidizing agent and the color image forming substance employed in the present invention are incorporated by a known method into packets having a hydrophilic or hydrophobic polymer as a wall material.

The silver halide which is incorporated into the packet emulsion can be spectrally sensitized so as to be sensitive to green light, red light or, if desired, infrared light with a sensitizing dye before the preparation of packets. Each of these spectrally sensitized silver halides is combined with a corresponding color image forming substance and incorporated into packets together with an organic silver salt oxidizing agent. For example, a combination of a blue-sensitive silver halide and a yellow color image forming substance, a combination of a green-sensitive silver halide and a magenta color image forming substance and a red-sensitive silver halide and a cyan color image forming substance can be employed. These three kinds of packet emulsions are mixed, to which are added an alkali agent and a reducing agent, if desired, and the mixture containing a hydrophilic colloid as a binder is coated on a support to obtain a heat-developable color photographic material. When two kinds of packet emulsions are used in a mixture it results in a heat-developable photographic material for two color images. Further, two kinds of yellow, magenta and cyan color image forming elements are mixed as a packet emulsion and another is added to a continuous phase of a hydrophilic binder together with a silver halide, an organic silver salt oxidizing agent, a color image forming substance, a reducing agent and, if desired, a color forming activator such as a base, which forms the same layer containing the packet emulsion or an adjacent layer thereto.

Examples of processes for preparation of the packet emulsions include conventional processes, for example, a method proposed by Goclowsky, et al. using a polymer packet forming agent which reacts with gelatin, etc. and renders it insoluble (as described in U.S. Pat. Nos. 2,698,794, 2,698,795, 2,698,796, 2,698,797, 2,787,544, 2,763,552, 2,843,488 and 2,835,580, etc.), a method utilizing coacervation of gelatin (as described in Japanese Patent Publication No. 12948/65, U.S. Pat. Nos. 3,276,869, 3,396,026 and 3,443,948, etc.), a method in which an emulsion and a color image forming substance are dispersed in a water-soluble polymer and then the dispersion is dispersed in a hydrophobic solvent or a solution of a hydrophobic polymer (as described in U.S. Pat. Nos. 2,893,867, 2,852,383 and 3,000,740, Japanese Patent Publication Nos. 1529/62, 28744/64, 28745/65 and 17183/66, etc.), a method in which an emulsion and a color image forming substance are dispersed in a solution of a hydrophobic polymer and then the dispersion is dispersed in a solution of a hydrophilic polymer (as described in U.S. Pat. Nos. 2,300,940, 2,284,877 and 2,490,749, etc.), a spray drying method (as described in U.S. Pat. No. 2,618,553, etc.) and the like.

Of these processes for preparation of the packet emulsion, the method utilizing complex coacervation of gelatin is most preferred in view of production stability, stability of coated sample during preservation, photographic properties, etc.

In general, the term "complex coacervation" means a phenomenon in which when two kinds of aqueous solutions of a polycationic colloid and a polyanionic colloid are mixed, there occurs a phase separation into two phases, i.e., a concentrated colloid phase (hereinafter referred to as complex coacervate) and a diluted colloid phase (hereinafter referred to as equilibrium solution) are formed due to an electrical interaction. The complex coacervate is deposited from the equilibrium solution in the form of droplets and observed as white turbidity. In this case, when a solid such as silver halide or a fine oil droplet containing a coloring material such as a coupler dissolved is present in the two kinds of aqueous colloidal solutions, it is generally believed that the complex coacervate is deposited so as to include a solid or droplet as a core substance. As a result, an original form of a packet emulsion is created wherein a solid such as silver halide or a fine droplet of liquid such as a coloring material dissolved in an oil is incorporated into a coacervate fine droplet. Further, it is then hardened with a hardening agent so as not to destroy the original form in the subsequent steps for preparation of photographic material such as dissolution, coating, etc. Also, prior to the hardening step, the equilibrium solution in which an original form of a packet emulsion formed is dispersed is cooled to a temperature of 25° C. or below, preferably 10° C. or below, whereby a good quality packet emulsion is obtained.

A method of preparing a packet emulsion in which silver halide, a sensitizing agent, and if desired, a coupler, a coupler solvent or a dye developer, etc., is incorporated by complex coacervation is described in, for example, Japanese Patent Publication No. 12948/65, U.S. Pat. Nos. 3,443,748, 3,276,869, 3,443,947 and 3,396,026, *Research Disclosure,* Vol. 135, No. 13520, etc.

The hydrophilic colloids which can be used in the complex coacervation are classified into two groups. A first group comprises compounds containing a nitrogen atom and an aqueous solution thereof has a negative charge at a pH higher than its isoelectric point and a positive charge at a pH lower than its isoelectric point. Examples of these compounds include gelatin, casein, albumen, hemoglobin, polyvinyl pyrrolidone, etc. A second group comprises compounds, an aqueous solution of which, always has a negative charge irrespective of pH. Examples of these compounds include a natural colloid such as sodium alginate, gum arabic, agar, pectin, konjak, etc., a synthetic polymer having an acid group or an alkali salt thereof such as a copolymer of polyvinyl methyl ether or polyethylene and maleic anhydride, carboxymethyl cellulose, polyvinylsulfonic acid, a condensation product of naphthalenesulfonic acid and formalin, etc., or a gelatin derivative in which a portion capable of having a positive charge is masked by phthalation or acetylation, etc. Of the compounds belonging to these two groups, gelatin, agar, sodium alginate, etc., can be gelated by cooling. Gelatin is most suitable for the preparation of the packet emulsion in view of its reversibility, that it is gelated by cooling and it is easily hardened with a hardening agent.

The reducing agent which can be used in the present invention is oxidized by the organic silver salt oxidizing agent to form an oxidized product capable of reacting with a dye releasing compound or a coupler and releasing or forming a dye to form a color image. An example of an effectively used reducing agent having such as ability is a color developing agent capable of forming an image upon oxidative coupling. Examples of the reducing agents used in the heat-developable color photographic material according to the present invention include a p-phenylenediamine type color developing agent including N,N-diethyl-3-methyl-p-phenylenediamine which is a typical example as described in U.S. Pat. No. 3,531,268. Further, an example of an effective reducing agent is an aminophenol as described in U.S. Pat. No. 3,761,270. Of the aminophenol type reducing agents, 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, etc., are particularly useful. Further, a 2,6-dichloro-4-substituted sulfonamidophenol, and a 2,6-dibromo-4-substituted sulfonamidophenol, etc., as described in *Research Disclosure,* Vol. 151, No. 15108 and U.S. Pat. No. 4,021,240 are also ueful. In addition to the phenol type reducing agents described above, a naphthol type reducing agent, for example, a 4-aminonaphthol derivative and a 4-substituted sulfonamidonaphthol derivative is useful. Moreover, a general application color developing agent, an aminohydroxy pyrazole derivative as described in U.S. Pat. No. 2,895,825, an aminopyrazoline derivative as described in U.S. Pat. No. 2,892,714, a hydrazone derivative as described in *Research Disclosure,* pages 227 to 230 and 236 to 240, Nos. RD-19412 and RD-19415 (June, 1980) may also be used. These reducing agents can be used individually or in a combination of two or more thereof.

In addition to the above described reducing agent, a reducing agent described below may be used as an auxiliary developing agent. Examples of useful auxiliary developing agents include hydroquinone, an alkyl substituted hydroquinone such as tertiary butylhydroquinone or 2,5-dimethylhydroquinone, etc., a catechol, a pyrogallol, a halogen substituted hydroquinone such as chlorohydroquinone or dichlorohydroquinone, etc., an alkoxy substituted hydroquinone such as methoxyhydroquinone, etc., and a polyhydroxybenzene derivative such as methyl hydroxynaphthalene, etc. Further, methyl gallate, ascorbic acid, an ascorbic acid derivative, a hydroxylamine such as N,N'-di(2-ethoxyethyl)-hydroxylamine, etc., a pyrazolidone such as 1-phenyl-3-pyrazolidone or 4-methyl-4-hydroxymethyl-1-phenyl-3-pyrazolidone, etc., a reductone and a hydroxy tetronic acid are also useful.

The reducing agent can be used in a certain range of concentration. In general, a suitable concentration range of the reducing agent is from about 0.1 mol to about 4 mols of the reducing agent per mol of the oxidizing agent. A suitable concentration of the reducing agent used in the present invention is generally from about 0.1 mol to about 20 mols of the reducing agent per mol of the oxidizing agent.

In the heat-developable color photographic material of the present invention, various kinds of bases or base releasing agents can be employed. By the use of the base or base releasing agent, a desirable color image can be obtained at a lower temperature.

Examples of preferred bases are amines which include a trialkylamine, a hydroxyalkylamine, an aliphatic polyamine, an N-alkyl substituted aromatic amine, an N-hydroxyalkyl substituted aromatic amine and a bis[p-(dialkylamino)phenol]methane. Further, betaine tetramethylammonium iodide and diaminobutane dihydrochloride as described in U.S. Pat. No. 2,410,644, and urea and an organic compound including an amino acid such as 6-aminocaproic acid as described in U.S. Pat. No. 3,506,444 are useful. The base releasing agent is a compound or a mixture which releases a basic component by heating, and the basic component is capable of activating the photographic material. Examples of typical base releasing agents are described in British Pat. No. 998,949. Preferred base releasing agents include a salt of a carboxylic acid and an organic base, and examples of suitable carboxylic acids include trichloroacetic acid and trifluoroacetic acid, etc., and examples of suitable bases include guanidine, piperidine, morpholine, p-toluidine and 2-picoline, etc. Guanidine trichloroacetate as described in U.S. Pat. No. 3,220,846 is particularly preferred. Further, an aldonic amide as described in Japanese Patent Application (OPI) No. 22625/75 is preferably used because it decomposes at high temperature to form a base.

Further, in the heat-developable color photographic material of the present invention, many known compounds which activate development and simultaneously stabilize the image can be effectively used. Of these compounds, an isothiuronium including 2-hydroxyethylisothiuronium.trichloroacetate as described in U.S. Pat. No. 3,301,678, a bisisothiuronium including 1,8-(3,6-dioxaoctane)bis(isothiuronium.trichloroacetate), etc., as described in U.S. Pat. No. 3,669,670, a thiol compound as described in West German Patent Application (OLS) No. 2,162,714, a thiazolium compound such as 2-amino-2-thiazolium.trichloroacetate and 2-amino-5-bromoethyl-2-thiazolium.trichloroacetate, etc., as described in U.S. Pat. No. 4,012,260, a compound having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and a compound having 2-carboxyamide as an acid part as described in U.S. Pat. No. 4,088,496, and the like are preferably used.

These compounds or mixtures thereof can be used in a wide range of amounts. It is preferable to use them in a range of 1/100 times to 10 times and, particularly 1/20 times to 2 times by molar ratio based on silver.

In the heat-developable color photographic material of the present invention, a diffusion accelerator can be incorporated into a binder in an amount which does not degrade the film quality thereof. The diffusion accelerator which is directly incorporated into the binder is preferably a non-hydrolyzable organic compound which is solid at an ambient temperature but melts at a temperature lower than the heat treatment temperature to be used. In a case wherein a dye imagewise released is transferred into a support, those which can get into the support during the heat treatment are preferred. Examples of preferred diffusion accelerators include diphenyl, o-phenylphenol, phenol, resorcinol and pyrogallol, etc. As the diffusion accelerator, a compound which is used as a thermal solvent can be generally used.

The term "thermal solvent" means a non-hydrolyzable organic material which is solid at an ambient temperature but melts together with other components at a temperature of heat treatment or a temperature lower than the heat treatment temperature. As the thermal solvent, a compound which becomes a solvent for the developing agent and a compound having a high dielectric constant which accelerate physical development of the silver salt, etc., are useful. Preferred examples of the thermal solvents include a polyglycol as described in U.S. Pat. No. 3,347,675, for example, polyethylene glycol having an average molecular weight of 1,500 to 20,000, a derivative such as an oleic acid ester of polyethylene oxide, etc., beeswax, monostearin, a compound having a high dielectric constant which has an —$SO_2$— or —CO— group such as acetamide, succinimide, ethylcarbamate, urea, methylsulfonamide, ethylene carbonate, a polar substance as described in U.S. Pat. No. 3,667,959, lactone of 4-hydroxybutanoic acid, methylsulfinylmethane, tetrahydrothiophene-1,1-dioxide, and 1,10-decanediol, methyl anisate, biphenyl suberate, etc., as described in *Research Disclosure,* pages 26 to 28 (Dec., 1976), etc.

For preventing irradiation or halation and improving the sharpness a filter dye or a light absorbing material as described in Japanese Patent Publication No. 3692/73, U.S. Pat. Nos. 3,253,921, 2,527,583 and 2,956,879, etc., can be incorporated. Preferably, these dyes have a thermal bleaching property. For example, dyes as described in U.S. Pat. Nos. 3,769,019, 3,745,009 and 3,615,432 are preferred.

The photographic material according to the present invention may contain, if desired, various additives known for the heat-developable photographic material and may have an antistatic layer, an electrically conductive layer, a protective layer, an intermediate layer, an antihalation layer and a strippable layer, etc., in addition to the photographic layer. As the additives, those described in *Research Disclosure,* Vol. 170, No. 17029 (June, 1978), for example, a plasticizer, a dye for improving sharpness, an antihalation dye, a sensitizing dye, a matting agent, a surface active agent, a fluorescent whitening agent, a fade preventing agent, etc., may be used.

The image receiving element (II) can contain a dye mordant. In the present invention, various mordants can be used, and a useful mordant can be selected according to properties of the dye, conditions for transfer, and other components contained in the photographic material, etc. The mordants which can be used in the present invention include high molecular weight polymer mordants.

Polymer mordants to be used in the present invention are polymers containing secondary and tertiary amino groups, polymers containing nitrogen-containing hetero-ring moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., N-vinyl imidazole polymers as disclosed in British Pat. No. 1,468,460, polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78, and 1024/78, etc.

In addition, mordants disclosed in U.S. Pat. Nos. 2,675,316 and 2,882,156 can be used.

Of these mordants, those which migrate with difficulty from a mordanting layer to other layers are preferable; for example, mordants capable of cross-linking with a matrix such as gelatin, water-insoluble mordants, and aqueous sol (or latex dispersion) type mordants are preferably used.

Particularly preferable polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

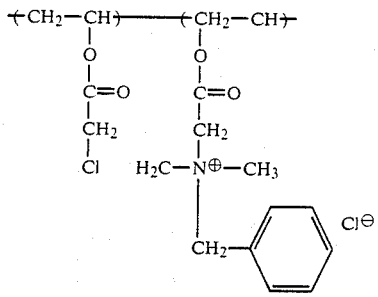

(2) Reaction products between a copolymer of a monomer represented by the following general formula with another ethylenically unsaturated monomer and a cross-linking agent (for example, bisalkanesulfonate, bisarenesulfonate, etc.):

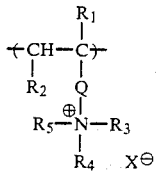

wherein $R_1$ represents a hydrogen atom or an alkyl group, $R_2$ represents a hydrogen atom, an alkyl group or an aryl group, Q represents a divalent group, $R_3$, $R_4$ and $R_5$ each represents an alkyl group, an aryl group or at least two of $R_3$ to $R_5$ are bonded together to form a hetero ring, and X represents an anion. The above described alkyl groups and aryl groups may be substituted.

(3) Polymers represented by the following general formula

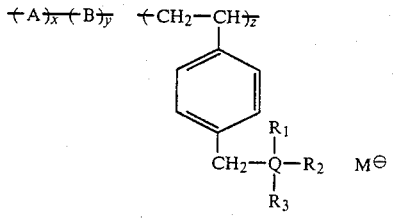

wherein X is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1$, $R_2$ and $R_3$ each represents an alkyl group or a cyclic hydrocarbon group or at least two of $R_1$ to $R_3$ are bonded together to form a ring (these groups and rings may be substituted), and M represents an anion.

(4) Copolymers composed of (a), (b) and (c), wherein (a) is

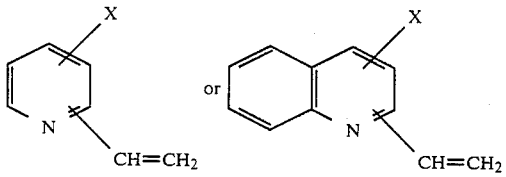

wherein X represents a hydrogen atom, an alkyl group or a halogen atom (the alkyl group may be substituted);

(b) is an acrylic ester; and (c) is acrylonitrile.

(5) Water-insoluble polymer wherein at least $\frac{1}{3}$ of the repeating units are those represented by the following general formula

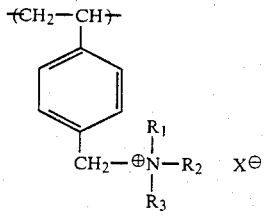

wherein $R_1$, $R_2$ and $R_3$ each represents an alkyl group, with the total number of carbon atoms being 12 or more (the alkyl group may be substituted), and X represents an anion.

Examples of the organic high molecular weight compounds used in the image receiving element (II) according to the present invention include polystyrene having a molecular weight of 2,000 to 85,000, a polystyrene derivative having a substituent containing not more than 4 carbon atoms, polyvinyl cyclohexane, polydivinyl benzene, polyvinyl pyrrolidone, polyvinyl carbazole, polyallyl benzene, polyvinyl alcohol, a polyacetal such as polyvinyl formal, polyvinyl butyral, etc., polyvinyl chloride, chlorinated polyethylene, polytrichlorofuluoroethylene, polyacrylonitrile, poly-N,N-dimethyl allylamide, a polyester such as a polyacrylate having a p-cyanophenyl group, a pentachlorophenyl group and a 2,4-dichlorophenyl group, polyacryl chloroacrylate, polymethyl metacrylate, polyethyl methacrylate, polypropyl methacrylate, polyisopropyl methacrylate, polyisobutyl methacrylate, polytertiary butyl methacrylate, polycyclohexyl methacrylate, polyethyleneglycol dimethacrylate, poly-2-cyanoethyl methacrylate, polyethylene terephthalate, etc., polysulfone, bisphenol A polycarbonate, a polycarbonate, polyanhydride, a polyamide, a cellulose acetate. Further, synthetic polymers having a glass transition temperature of from 40° C. to 250° C. as described in J. Brandrup and E. H. Immergut, *Polymer Handbook*, 2nd Edition (John Wiley & Sons) are useful. These high molecule weight compounds can be used individually or as a copolymer composed of a combination of two or more thereof.

The support used in the present invention is that which can endure at the processing temperature. Examples of useful common supports include not only glass, paper, metal and analogues thereof, but also an organic polymer film. Examples of particularly preferred supports include a cellulose acetate film such as cellulose triacetate, cellulose diacetate, etc., a polyamide film such as a combination of heptamethylenediamine and terephthalic acid, a combination of fluorenedipropylamine and adipic acid, a combination of hexamethylenediamine and diphenic acid, a combination of hexamethylenediamine and isophthalic acid, etc., a polyester film such as a combination of diethyleneglycol and diphenylcarboxylic acid, a combination of bis-p-carboxyphenoxy butane and ethyleneglycol, etc., a polyethylene terephthalate film and a polycarbonate film. These films may be modified. For example, a polyethylene terephthalate film modified using cyclohexanedimethanol, isophthalic acid, methoxypolyethylene glycol, 1,2-dicarbomethoxy-4-benzenesulfonic acid, etc. as a modifying agent is effectively used.

The support can be composed of a single layer or two or more layers. Further, the support may contain titanium dioxide or have thereon a portion or a layer containing titanium dioxide to form a white reflective layer.

The protective layer, the intermediate layer, the subbing layer, the back layer and other layers can be produced by preparing each coating solution and applying in order to the support by various coating methods such as a dip coating method, an air-knife coating method, a curtain coating method, a hopper coating method, as described in U.S. Pat. No. 3,681,294 and drying to prepare the photographic material, in a manner similar to the heat-developable photographic layer according to the present invention. If desired, two or more layers may be applied at the same time by the method as described in U.S. Pat. No. 2,761,791 and British Pat. No. 837,095.

For the heat-developable photographic material of the present invention, various means for exposing to light can be used. A latent image is obtained by imagewise exposure to radiant rays including visible rays. Generally, a light source used for conventional color prints can be used, examples of which include a tungsten lamp, a mercury lamp, a halogen lamp such as an iodine lamp, etc., a xenon lamp, a laser light source, a CRT light source, a fluorescent tube, a light-emitting diode, etc.

As the original, not only a line drawing but a photograph having gradation may be used. It is also possible to take a photograph of a portrait or landscape by means of a camera. Printing from the original may be carried out by contact printing by superimposing the original on the photographic material or may be carried out by reflection printing or enlargement printing.

Further, it is possible to carry out the printing of an image photographed by a videocamera or image information sent from a television broadcasting station by displaying directly on CRT of FOT and focusing the resulting image on the heat-developable photographic material by contacting therewith or by means of a lens.

Recently, LED (light-emitting diode) which has been greatly improved is utilized as an exposure means or display means for various apparatus and devices. It is difficult to produce LED which effectively emits blue light. In this case, in order to reproduce the color image, three kinds of LED consisting of those emitting each green light, red light and infrared light are used, and the silver halide emulsions sensitive to these lights are designed so as to be combined with a yellow, magenta and cyan color image forming substance, respectively.

Besides the above described methods for contact exposure or projection of the original, there can be used a method of exposure wherein the original illuminated by a light source is stored in a memory of a leading computer by means of a light-receiving means such as a phototube or CCD, etc., the information is, if desired, subjected to processing, the so-called image treatment, and the resulting image information is reproduced on CRT to utilize as an imagelike light source or three kinds of LED are emitted according to the processed information.

After the heat-developable color photographic material is exposed to light, the latent image thus obtained can be developed and diffusion transferred by heating the whole material at a suitably elevated temperature, for example, from about 80° C. to about 250° C. for from about 0.5 second to about 300 seconds, preferably 0.5 second to 120 seconds. Any higher temperature or lower temperature can be utilized by prolonging or shortening the heating time, if it is within the above described range. Particularly, a temperature range from about 120° C. to about 190° C. is useful. As a heating means, a simple heat plate, an iron, a heat roller or analogues thereof may be used.

The present invention will be explained in greater detail with reference to the following examples, but the present invention should not be construed as being limited thereto.

EXAMPLE 1

Gelatin capsules retaining a water-immiscible diffusion accelerator were prepared according to the complex coacervation method in the manner as described below.

20 g of gum arabic was dissolved in 160 ml of warm water and to which was poured with stirring a solution containing 80 g of Diffusion Accelerator (A) described below dissolved in 40 g of butyl acetate whereby an o/w type emulsion was formed. When an average particle size of the oil droplets became from 5 μm to 10 μm, a solution containing 20 g of an acid processed gelatin having an isoelectric point of 8 dissolved in 160 ml of water was added to the emulsion and thoroughly mixed. After adjusting the pH of the mixture to 5 using a 10% sodium hydroxide solution at 45° C., 500 ml of warm water was poured thereto and the pH was adjusted to 4.6 with a 10% acetic acid. After cooling at not more than 10° C., 15 ml of a 10% formalin was added to the mixture, the pH of which was adjusted to 10.0 using a 10% sodium hydroxide solution and the temperature of the mixture was elevated to 45° C. to accelerate hardening of the capsule wall. After colling to room temperature, the pH of the mixture was readjusted to 7.0 with a 10% acetic acid to obtain a natural microcapsule dispersion of the water-immiscible diffusion accelerator. Diffusion Accelerator (A): Diethyl laurylamide

EXAMPLE 2

Capsules having a urea-formaldehyde resin wall and retaining the water-immiscible diffusion accelerator (B) described below were prepared in the following manner.

24 g of urea was dissolved in 48.9 g of a 37% formalin, the pH of the solution was adjusted to 8.0 with triethanolamine and heated at 70° C. for 1 hour to prepare a urea-formalin prepolymer. After readjusting the pH thereof to between 8.0 and 9.0 using a 10% aqueous solution of citric acid, 70 g of Diffusion Accelerator (B) and 30 g of butyl acetate were added thereto and the mixture was dispersed using a stirrer with 1200 rpm. After adjusting the pH of the mixture to 3.5 with a 10% aqueous solution of citric acid, the mixture was heated at a temperature between 40° C. and 45° C. for 40 minutes. After adding 50 ml of warm water, the mixture was further reacted for 3 hours. The reaction was terminated by addition of 300 ml of cold water and the mixture was filtered to obtain the capsules having a urea-formaldehyde resin wall and retaining the water-immiscible diffusion accelerator.

Diffusion Accelerator (B): Tricresyl phosphate

EXAMPLE 3

Polyester capsules retaining a water-immiscible diffusion accelerator were prepared in the following manner.

0.2 g of terephthaloyl chloride was dissolved in 25 ml of chlorinated diphenyl to prepare a solution. The solution was emulsified in 200 ml of a 0.5% aqueous solution of sodium hydrogen carbonate. 50 ml of a 10% ethyleneglycol was added to the solution while thoroughly stirring and an interfacial polymerization reaction was carried out. After 10 minutes, the reaction mixture was centrifuged to obtain the polyester capsules having an average size of from 20 μm to 30 μm.

EXAMPLE 4

A silver benzotriazole emulsion containing light-sensitive silver bromide was prepared in the following manner.

6.5 g of benzotriazole and 10 g of gelatin were dissolved in 1,000 ml of water and the solution was stirred while maintaining the temperature at 50° C. A solution containing 8.5 g of silver nitrate dissolved in 10 ml of water was added to the above described solution for a period of 2 minutes and thus silver benzotriazole was formed. Then a solution containing 1.19 g of potassium bromide and 0.083 g of potassium iodide dissolved in 50 ml of water was added to the above described mixture for a period of 5 minutes. It is believed that on this step silver was supplied from the silver benzotriazole to form crystals of silver iodobromide (iodide: 20 mol%) adjacent to the silver benzotriazole. By controlling a pH of the emulsion thus prepared precipitation was caused and the undesirable salts were removed. The pH of the emulsion was adjusted to 6.0 and 400 g of the emulsion was obtained.

A coupler dispersion was prepared in the following manner.

10 g of Coupler (1) described below was dissolved in 30 ml of tricresyl phosphate and the solution was dispersed in 100 g of a 10% aqueous gelatin solution using 0.5 g of sodium dodecylbenzenesulfonate as an emulsifier to prepare Coupler Dispersion (1)

Coupler (1)

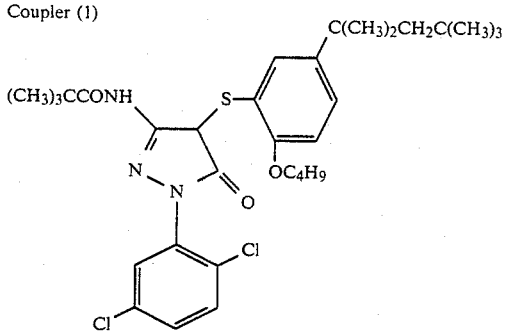

A coating solution containing 15 g of the silver benzotriazole emulsion partially halogenated described above, 3 g of Coupler Dispersion (1), 15 ml of water, 0.1 g of guanidine trichloroacetate and 0.1 g of 2,6-dichloro-p-aminophenol was coated on a polyethylene terephthalate film at a wet thickness of 100 μm and dried to prepare Heat-Developable Color Photographic Material 410.

On a polyethylene terephthalate film support having coated thereon a gelatin reflective layer containing titanium dioxide was coated a mordant layer containing a copolymer of polystyrene and poly(N,N,N-tri-n-hexyl-N-vinylbenzyl ammonium chloride) in a ratio of 1:1 as a mordant to prepare Image Receiving Sheet 450. Also, on the mordant layer of Image Receiving Sheet 450 was further coated a mixture of 30 g of the gelatin capsule dispersion containing the water-immiscible diffusion accelerator prepared in Example 1 and 3 g of a 10% aqueous gelatin solution to prepare Image Receiving Sheet 460. The dry thickness of the mordant layer was 6 μm and that of the diffusion accelerator containing layer was 10 μm.

Photographic Material 410 described above was exposed imagewise to light at 2,000 lux for 10 seconds using a tungsten lamp, superposed on Image Receiving Sheet 450 or Image Receiving Sheet 460 and then uniformly heated on a heat block which had been heated at 150° C. for 30 seconds.

As a result, the negative magenta images were obtained on Image Receiving Sheets 450 and 460. The optical densities of the negative magenta images were measured using a Macbeth reflection densitometer (RD-219). The maximum reflective density and the minimum reflective density to green light thus obtained are shown in Table 1 below.

TABLE 1

| Image Receiving Sheet | Maximum Reflective Density | Minimum Reflective Density |
|---|---|---|
| 450 | 0.35 | 0.29 |
| 460 | 1.83 | 0.38 |

It is apparent from the results shown in Table 1 above that the magenta color image is scarcely transferred on Image Receiving Sheet 450 which does not have the microcapsule layer containing the diffusion accelerator. On the contrary, there is sufficient transfer of the negative magenta image on Image Receiving Sheet 460 having the microcapsule layer containing the diffusion accelerator.

EXAMPLE 5

On the mordant layer of Image Receiving Sheet 450 as described in Example 4 was coated a coating solution obtained by dispersing 50 g of the microcapsule containing the diffusion accelerator prepared in Examples 2 and 3 in 50 g of a 2% aqueous gelatin solution at a dry thickness of about 10 μm to prepare Image Receiving Sheets 550 and 560, respectively. Using photographic Material 410 and Image Receiving Sheets 550 and 560, the exposure to light and the development and transfer by heating were carried out in the same manner as described in Example 4.

As a result, the negative magenta images having the maximum reflective densities of 1.21 and 1.38 and the minimum reflective densities of 0.28 and 0.33 were obtained on Image Receiving Sheets 550 and 560, respectively.

EXAMPLE 6

A silver benzotriazole emulsion containing light-sensitive silver bromide was prepared in the following manner.

| | | |
|---|---|---|
| (A) | Benzotriazole | 12 g |
| | Isopropyl alcohol | 200 ml |
| (B) | Silver nitrate | 17 g |

-continued

| | | |
|---|---|---|
| | Water | 50 ml |
| (C) | Lithium bromide | 2.1 g |
| | Ethanol | 20 ml |

Solution B was added to Solution A with stirring at 40° C. Solution A became turbid and silver salts of benzotriazole were formed.

To the resulting solution, Solution C was added, by which silver was supplied from the silver benzotriazole to convert part of the silver benzotriazole into silver bromide.

The resulting powdery crystals were collected by filtration and they were added to a polymer solution prepared by dissolving 20 g of polyvinyl butyral in 200 ml of isopropyl alcohol, followed by dispersing for 30 minutes by a homogenizer.

To 10 g of the above described silver benzotriazole emulsion containing light-sensitive silver bromide was added a solution prepared by dissolving 0.39 g of the dye releasing compound having the following formula:

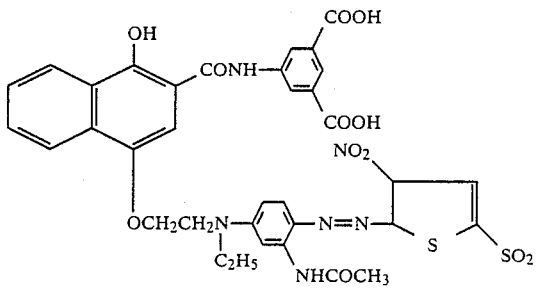

0.18 g of 2,6-dichloro-4-aminophenol and 0.22 g of guanidine trichloroacetate in a mixture of 4 ml of ethyl alcohol, 3 ml of ethyl acetate and 3 ml of N,N-dimethylformamide and stirred. The resulting mixture was applied to a polyethylene terephthalate film at a wet thickness of 100 μm, and dried to prepare Photographic Material 610. Also, on the emulsion layer of Photographic Material 610 was further coated a mixture of 30 g of the gelatin capsule dispersion containing the water-immiscible diffusion accelerator prepared in Example 1 and 3 g of a 10% aqueous gelatin solution at a dry thickness of 10 μm and dried to prepare Photographic Material 620.

The resulting Photographic Materials 610 and 620 were imagewise exposed to light at 2,000 lux for 100 seconds using a tungsten lamp, superposed on Image Receiving Sheet 450 prepared in Example 4 and then uniformly heated on a heat panel which had been heated at 160° C. for 30 seconds.

As a result, the negative cyan image was obtained on the image receiving sheet in the case of using Photographic Material 620. The optical density of the negative cyan image was measured using a Macbeth reflection densitometer (RD-219) and the maximum reflecture density and the minimum reflective density to red light were 2.03 and 0.54, respectively. On the contrary, the maximum reflective density of the negative cyan image obtained using Photographic Material 610 was only below 0.5.

EXAMPLE 7

Preparation of a silver iodobromide emulsion

To 1,000 ml of water, 20 g of gelatin, 9.52 g of potassium bromide and 3.32 g of potassium iodide were dissolved and the solution was stirred while maintaining the temperature at 50° C. To the solution was added a solution containing 17 g of silver nitrate dissolved in 100 ml of water for a period of 10 minutes. Then, the mixture was cooled to 35° C. The pH of the emulsion was controlled to form a precipitate and the excess salts were removed. The pH of the emulsion was adjusted to 6.0 and 200 g of silver iodobromide (iodide: 20 mol%) emulsion was obtained.

Preparation of a silver benzotriazole emulsion 6.5 g of benzotriazole and 10 g of gelatin were dissolved in 1,000 ml of water and the solution was stirred while maintaining the temperature at 50° C. A solution containing 8.5 g of silver nitrate dissolved in 100 ml of water was added to the above described solution for a period of 2 minutes. By controlling the pH of the emulsion thus prepared to form a precipitate the undesirable salts were removed. The pH of the emulsion was adjusted to 6.0 and 400 g of silver benzotriazole emulsion was obtained.

Preparation of a coupler dispersion

A coupler dispersion was prepared by dissolving 10 g of Coupler (1) as described in Example 4 in 30 ml of tricresyl phosphate and dispersing the solution in 110 g of a 10% aqueous gelatin solution containing 0.5 g of sodium dodecylbenzenesulfonate.

Preparation of a packet emulsion 4 g of the silver iodobromide emulsion prepared above was dissolved, to which was added $4\times10^{-4}$ mol of 3,3'-di(γ-sulfopropyl)-5,5'-diphenyl-9-ethyloxacarbocyanine sodium salt per mol of the silver halide and stirred for 5 minutes. Then, 20 g of the above described coupler dispersion and 30 g of the silver benzotriazole emulsion prepared above were added to the mixture and dissolved.

To the mixture were added 30 ml of a 10% aqueous solution of gum arabic and 100 ml of water and while stirring at 45° C. the pH of the mixture was adjusted to 4.80 by adding a 1% aqueous solution of acetic acid. After stirring for 15 minutes, the mixture was cooled to 7° C. and stirred for 30 minutes. 150 ml of water containing 0.14 g of chromium alum was added, the mixture was further stirred for 1 hour and then a 5% aqueous sodium carbonate solution was added thereto. The mixture was allowed to stand overnight and the supernatant liquid was removed by decantation. The packet emulsion thus prepared was designated Packet Emulsion (1).

Packet Emulsion (2) was prepared in the same manner as described in the preparation of Packet Emulsion (1) except that 3,3'-di(γ-sulfopropyl)-9-methylthiadicarbocyanine sodium salt and Coupler (2) described below were used in place of the sensitizing dye and Coupler (1) respectively.

Coupler (2):

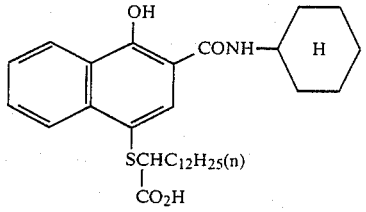

Preparation of a photographic material 10 g of a microcapsule of water-immiscible Diffusion Accelerator (A) which was prepared in the same manner as described in Example 1 except that a capsule size was about 5 μm by using a high stirring speed, 10 g of Packet Emulsion (1) prepared above, 10 g of Packet Emulsion (2) prepared above and 4 g of a 10% aqueous gelatin solution were mixed and dissolved. To the solution were added 0.1 g of guanidine trichloroacetate and 1 ml of a 10% methanol solution of 2,6-dichloro-p-aminophenol as a reducing agent and the mixture was coated at a wet thickness of 300 μm. A photographic material thus prepared was designated Photographic Material 720.

Photographic Material 710 was prepared in the same manner as described in Photographic Material 720 except that the microcapsule of the diffusion accelerator was not added and a wet thickness of the coating was 200 μm.

Preparation of an image receiving sheet

On a polyethylene terephthalate film having a reflective titanium dioxide containing layer, a coating solution containing a copolymer of polystyrene and poly(N,N,N-tri-n-hexyl-N-vinylbenzyl ammonium chloride) (a ratio of polystylene and vinylbenzyl ammonium chloride being 1:1), gelatin and polyethylene glycol having a molecular weight of 2,000 in a ratio of 2:1:0.5 was coated at a dry thickness of 5 mμ to prepare Image Receiving Sheet 730.

Heat Development and Diffusion Transfer

Photographic Materials 710 and 720 prepared described above were exposed stepwise to red light and green light according to two color separation, superposed on Image Receiving Sheet 730 and uniformly heated on a heat panel which had been heated at 160° C. for 60 seconds. The image receiving sheet was peeled apart from the photographic material.

It is apparent from the results show in Table 2 below that negative cyan and magenta images of color separation were obtained on the image receiving sheet when Photographic Material 720 was used. On the contrary, the transferred image was scarcely obtained when using Photographic Material 710.

TABLE 2

| Photographic Material | Magenta Maximum Color Density | Magenta Minimum Color Density | Cyan Maximum Color Density | Cyan Minimum Color Density | Remarks |
|---|---|---|---|---|---|
| 710 | 0.31 | 0.25 | 0.29 | 0.21 | Comparison |
| 720 | 1.85 | 0.63 | 1.53 | 0.58 | Present Invention |

The cyan and magenta densities were measured using a Macbeth reflection densitometer (RD-219).

While the invention has been described in detail and with reference to specific embodiments thereof, it will be apparent to one skilled in the art that various changes and modifications can be made therein without departing from the spirit and scope thereof.

What is claimed is:

1. A heat-developable diffusion transfer color photographic material comprising a heat-developable color photographic element containing a light-sensitive silver halide, an organic silver salt oxidizing agent and a color image forming substance containing a color image forming dye which does not contain a group having a charge and an image receiving element capable of accepting a dye which is formed or released in the heat-developable color photographic element, the heat-developable color photographic element and the image receiving element being provided on a support having further provided thereon microcapsules comprised of a water-immiscible core material compound which is liquid at a temperature of not less than 120° C. and a water-insoluble polymer, wherein the color image forming substance is a compound containing a dye selected from the group consisting of an azo dye, an azomethine dye, an anthraquinone dye, a naphthoquinons dye, a nitro dye, a styryl dye, a quinophthalone dye, a triarylmethane dye, a phthalocyanine dye and a precursor thereof.

2. A heat-developable diffusion transfer color photographic material as claimed in claim 1, wherein the water-immiscible compound is an organic solvent having a high boiling point of not less than 200° C.

3. A heat-developable diffusion transfer color photographic material as claimed in claim 2, wherein the organic solvent having a high boiling point is one member selected from the group consisting of a phthalic acid alkyl ester, a phosphoric acid ester, a citric acid ester, an alkyl amide, a fatty acid ester and a trimesic acid ester.

4. A heat-developable diffusion transfer color photographic material as claimed in claim 1, wherein the water-immiscible compound is an organic solvent having a low boiling point of less than 200° C.

5. A heat-developable diffusion transfer color photographic material as claimed in claim 4, wherein the organic solvent having a low boiling point is one member selected from the group consisting of a lower alkyl ester, a hydrocarbon, a substituted hydrocarbon, a hydroxy compound, an ester, a ketone and a nitrogen compound.

6. A heat-developable diffusion transfer color photographic material as claimed in claim 2, wherein the organic solvent having a high boiling point is used as a mixture with an organic solvent having a low boiling point of from 50° C. to 180° C.

7. A heat-developable diffusion transfer color photographic material as claimed in claim 6, wherein the organic solvent, having a low boiling point is an organic solvent having a boiling point of from 80° C. to 160° C.

8. A heat-developable diffusion transfer color photographic material as claimed in claim 6, wherein the amount of the organic solvent having a low boiling point is not more than 50% by weight of the organic solvent having a high boiling point.

9. A heat-developable diffusion transfer color photographic material as claimed in claim 1, wherein the microcapsule is prepared by a method selected from the group consisting of a phase separation method, an interfacial polymerization method, a method for polymerization of a wall material in oil droplets, a melting, dispersing and cooling method, a method by deposition of a polymer and a method in which reactants are supplied from the inside of oil droplets.

10. A heat-developable diffusion transfer color photographic material as claimed in claim 1, wherein the water-insoluble polymer wall comprises hardened gelatin.

11. A heat-developable diffusion transfer color photographic material as claimed in claim 1, wherein the microcapsule is prepared by complex coacervation of gelatin and an anionic charge neutralizing agent.

12. A heat-developable diffusion transfer color photographic material as claimed in claim 1, wherein the microcapsules have a size of not more than 100 mμ.

13. A heat-developable diffusion transfer color photographic material as claimed in claim 1, wherein the microcapsules range in size from 1 μm to 50 μm.

14. A heat-developable diffusion transfer color photographic material as claimed in claim 1, wherein the microcapsules range in size from 1 μm to 20 μm.

15. A heat-developable diffusion transfer color photographic material as claimed in claim 1, wherein the microcapsules are incorporated into the photographic element.

16. A heat-developable diffusion transfer color photographic material as claimed in claim 15, wherein the microcapsules are incorporated into an emulsion layer of the photographic element.

17. A heat-developable diffusion transfer color photographic material as claimed in claim 1, wherein the microcapsules are incorporated into the image receiving element.

18. A heat-developable diffusion transfer color photographic material as claimed in claim 17, wherein the microcapsules are incorporated into an image receiving layer of the image receiving element.

19. A heat-developable diffusion transfer color photographic material as claimed in claim 1, wherein the microcapsules are present in an amount of from 0.1 $g/m^2$ to 100 $g/m^2$ calculated as an amount of the water-immiscible core material compound.

20. A heat-developable diffusion transfer color photographic material as claimed in claim 1, wherein the microcapsules are present in an amount of from 1 $g/m^2$ to 30 $g/m^2$ calculated as an amount of the water-immiscible core material compound.

21. A heat-developable diffusion transfer color photographic material as claimed in claim 1, wherein the color image forming substance is a coupler capable of forming a dye by reaction with an oxidized product of a reducing agent.

22. A heat-developable diffusion transfer color photographic material as claimed in claim 21, wherein the coupler is one member selected from the group consisting of couplers represented by the following general formula (I), (II), (III), (IV), (V) and (VI):

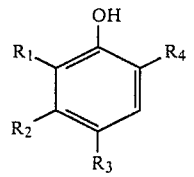
(I)

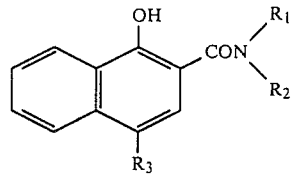
(II)

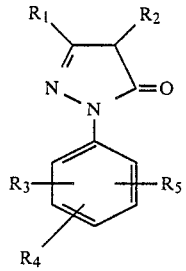
(III)

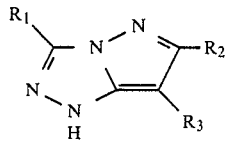
(IV)

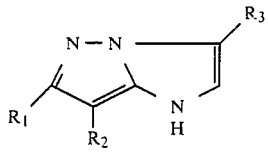
(V)

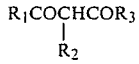
(VI)

wherein $R_1$, $R_2$, $R_3$, $R_4$ and $R_5$, which may be the same or different, each represents a hydrogen atom or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group, a cyano group, an alkylsulfonyloxy group, an arylsulfonyloxy group, an alkyl sulfonylamino group, an arylsulfonylamino group, an alkylthio group, an arylthio group, an arylazo group, a heterocyclic residue, a group of

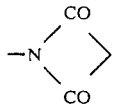

and a group of

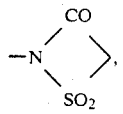

and wherein the substituents may be further substituted with a hydroxy group, a carboxy group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

23. A heat-developable diffusion transfer color photographic material as claimed in claim 1, wherein the color image forming substance is a compound capable of releasing a diffusible dye upon reaction with an oxidized product of a reducing agent.

24. A heat-developable diffusion transfer color photographic material as claimed in claim 23, wherein the color image forming substance is represented by the following general formula (VII):

C—L—D (VII)

wherein C represents a substituent capable of bonding to an oxidized product which is formed by a reaction between a reducing agent and an organic silver salt oxidizing agent; D represents a dye portion for forming an image; and L represents a connection group between C and D and the bond between C and L is cleaved upon the reaction of C with the oxidized product of the reducing agent.

25. A heat-developable diffusion transfer color photographic material as claimed in claim 24, wherein the substituent represented by C is an active methylene residue, an active methine residue, a phenol residue or a naphthol residue.

26. A heat-developable diffusion transfer color photographic material as claimed in claim 25, wherein the substituent represented by C is a compound selected from the group consisting of compounds represented by the following general formula (VIII), (IX), (X), (XI), (XII), (XIII) and (XIV):

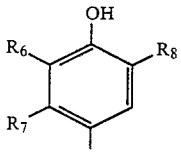

(VIII)

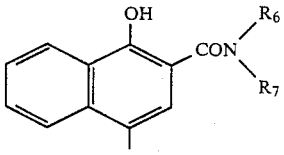

(IX)

-continued

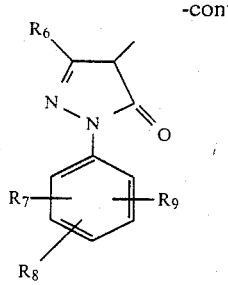

(X)

$R_6COCHCOR_7$ (XI)

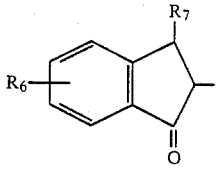

(XII)

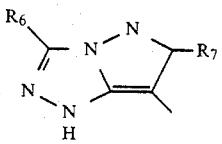

(XIII)

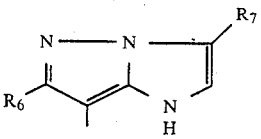

(XIV)

wherein $R_6$, $R_7$, $R_8$ and $R_9$, which may be the same or different, each represents a hydrogen atom or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and wherein the substituents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

27. A heat-developable diffusion transfer color photographic material as claimed in claim 1, wherein the color image forming substance is a dye releasing reducing compound capable of releasing a diffusible dye in the presence of a nucleophilic agent when the dye releasing reducing compound is oxidized.

28. A heat-developable diffusion transfer color photographic material as claimed in claim 27, wherein the dye releasing reducing compound is represented by the following general formula (XV):

$R—SO_2—D$ (XV)

wherein R represents a reducing substituent capable of being oxidized by the organic silver salt oxidizing agent;

and D represents a dye portion for forming a color image.

29. A heat-developable diffusion transfer color photographic material as claimed in claim 28, wherein the reducing substituent represented by R is a compound selected from the group consisting of compounds represented by the following general formula a (XVI), (XVII), (XVIII), (XIX), (XX), (XXI), (XXII) and (XXIII):

(XVI)

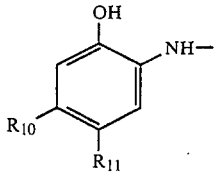

(XVII)

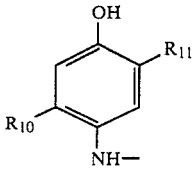

(XVIII)

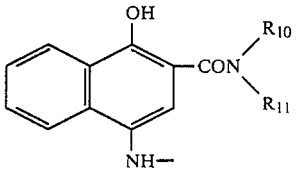

(XIX)

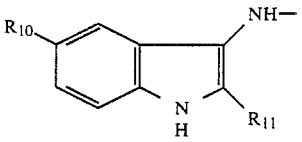

(XX)

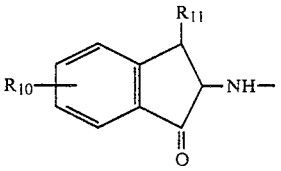

(XXI)

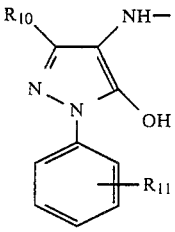

(XXII)

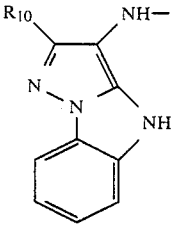

-continued (XXIII)

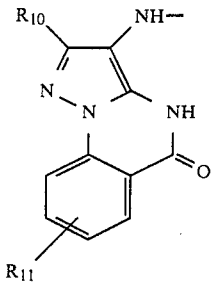

wherein $R_{10}$ and $R_{11}$, which may be the same or different, each represents a hydrogen atom or a substituent selected from the group consisting of an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group and an N-substituted sulfamoyl group, and wherein the substituents may be further substituted with a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group.

30. A heat-developable diffusion transfer color photographic material as claimed in claim 1, wherein the color image forming substance is a silver salt of a silver salt forming dye capable of releasing a metal silver upon an oxidation-reduction reaction with a reducing agent to make the silver salt forming dye diffusible.

31. A heat-developable diffusion transfer color photographic material as claimed in claim 30, wherein the silver salt forming dye is represented by the following general formula (XXIV):

D—AH (XXIV)

wherein D represents a dye portion for forming a color image; and AH represents a group having a silver salt forming function.

32. A heat-developable diffusion transfer color photographic material as claimed in claim 1, wherein the color image forming substance is a leuco body or a precursor thereof capable of being oxidized to an original dye upon an oxidation-reduction reaction with an organic silver salt oxidizing agent.

33. A heat-developable diffusion transfer color photographic material as claimed in claim 1, wherein the color image forming substance is a dye capable of being bleached by the action of metal silver, a silver ion complex forming agent and an electron transferring agent in the presence of an acid.

34. A heat-developable diffusion transfer color photographic material as claimed in claim 1, wherein the color image forming dye is a dye selected from the group of dyes represented by the following general formulae:

Yellow:

-continued
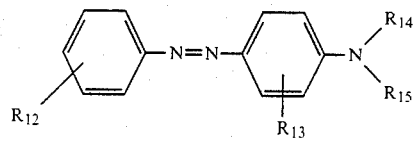
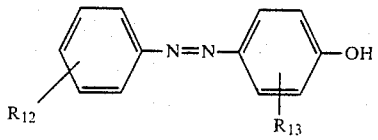
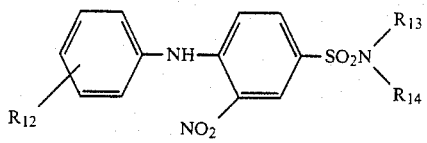
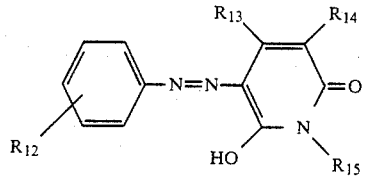
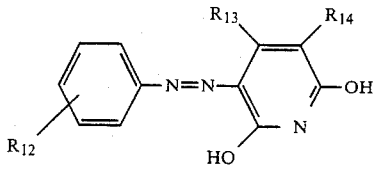
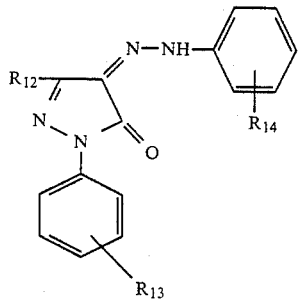
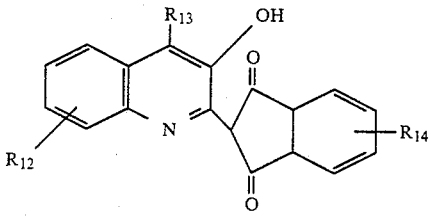
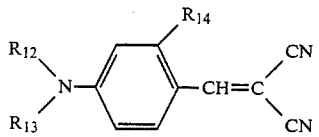
-continued
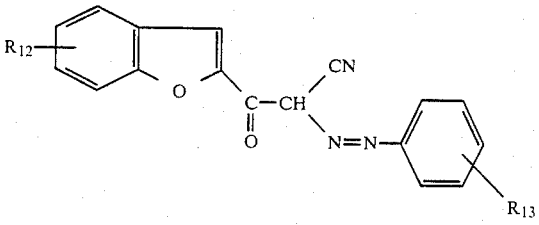
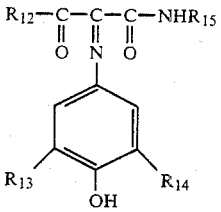
Magenta:
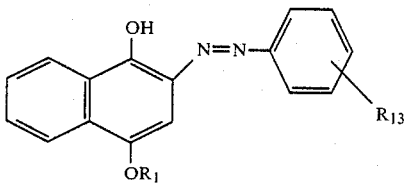
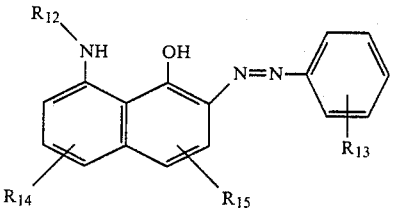
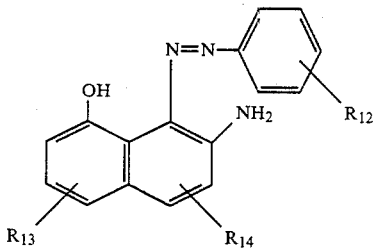
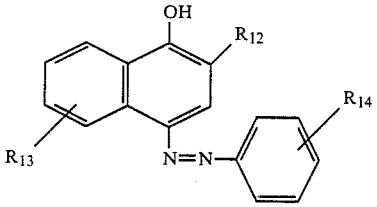

-continued
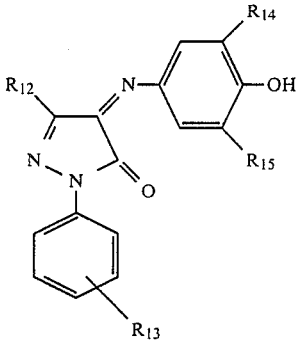
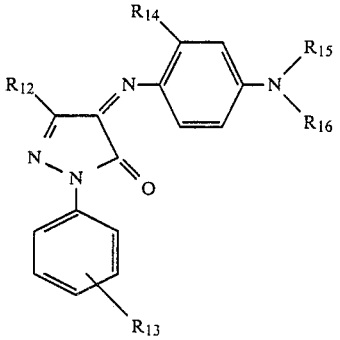
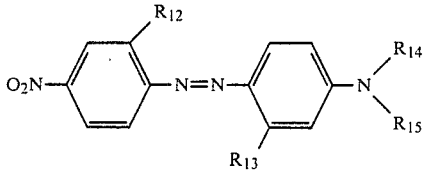
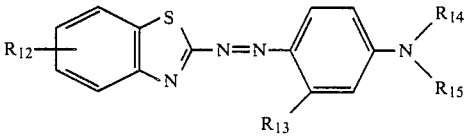
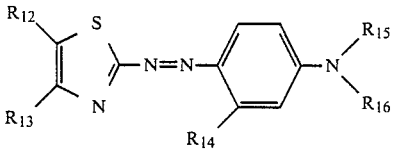
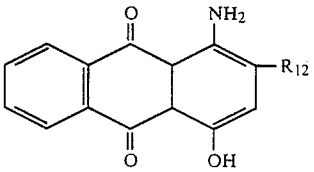
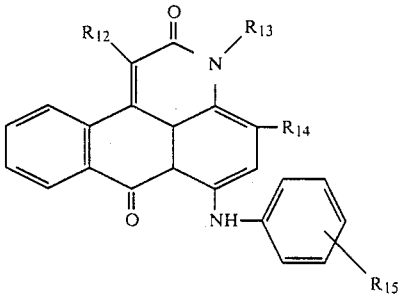
-continued
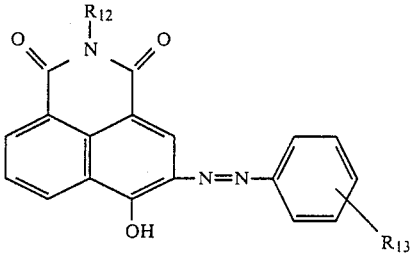
Cyan:
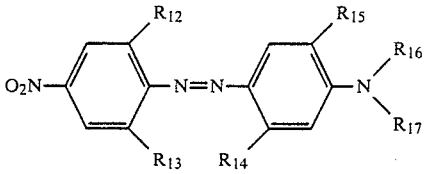
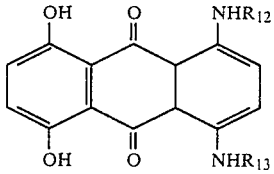
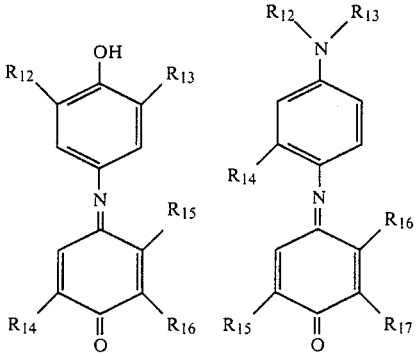
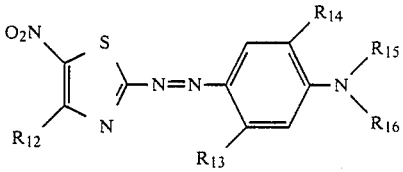
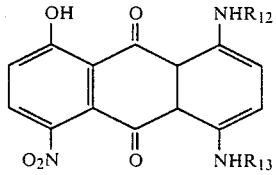
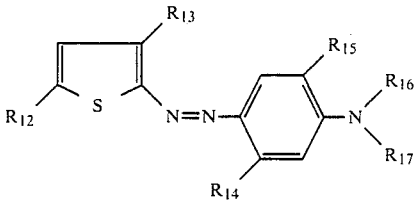

-continued

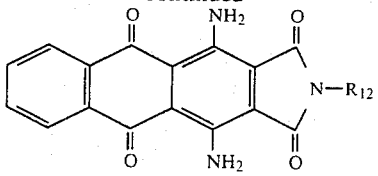

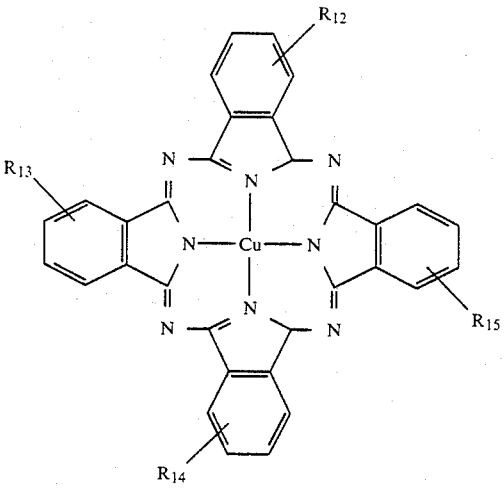

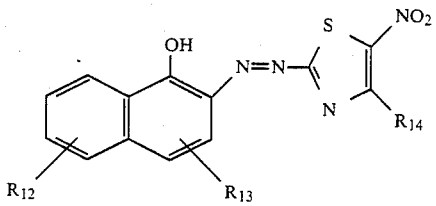

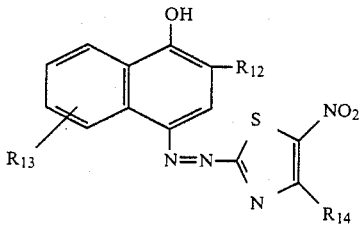

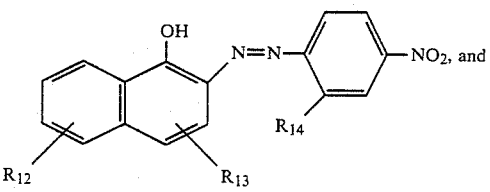

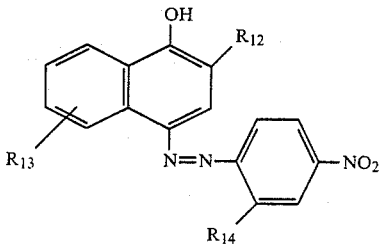

wherein $R_{12}$ to $R_{17}$ each represents a hydrogen atom or a substituent selected from the group consisting of an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group and an arylthio group.

35. A heat-developable diffusion transfer color photographic material as claimed in claim 1, wherein the light-sensitive silver halide is selected from the group of silver halide consisting of silver chloride, silver chlorobromide, silver chloroiodide, silver bromide, silver iodobromide, silver chloroiodobromide and silver iodide.

36. A heat-developable diffusion transfer color photographic material as claimed in claim 1, wherein the light-sensitive silver halide is present in a range from 0.005 mols to 5 mols per mol of the organic silver salt oxidizing agent.

37. A heat-developable diffusion transfer color photographic material as claimed in claim 1, wherein the particle size of the silver halide is from 0.001 $\mu$m to 2 $\mu$m.

38. A heat-developable diffusion transfer color photographic material as claimed in claim 1, wherein the organic silver salt oxidizing agent is a silver salt which is comparatively stable to light and which forms a silver image by reacting with the color image forming substance or a reducing agent coexisting with the color image forming substance, when it is heated to a temperature of above 80° C. in the presence of exposed silver halide.

39. A heat-developable diffusion transfer color photographic material as claimed in claim 38, wherein the organic silver salt oxidizing agent is a silver salt of an organic compound having a carboxy group, a silver salt of a compound containing a mercapto group or a thione group or a silver salt of a compound containing an imino group.

40. A heat-developable diffusion transfer color photographic material as claimed in claim 1, wherein the light-sensitive silver halide and the organic silver salt oxidizing agent are present in the same layer.

41. A heat-developable diffusion transfer color photographic material as claimed in claim 1, wherein a coating amount of the light-sensitive silver halide and the organic silver salt oxidizing agent are present in a total amount of from 50 mg/m$^2$ to 10 g/m$^2$ calculated as an amount of silver.

42. A heat-developable diffusion transfer color photographic material as claimed in claim 1, wherein the color photographic material further comprises a binder.

43. A heat-developable diffusion transfer color photographic material as claimed in claim 42, wherein the binder is a hydrophilic polymer or a hydrophobic polymer.

44. A heat-developable diffusion transfer color photographic material as claimed in claim 1, wherein the light-sensitive silver halide, the organic silver salt oxidizing agent and the color image forming substance are incorporated into a packet comprising a hydrophilic or hydrophobic polymer as a wall material.

45. A heat-developable diffusion tranfer color photographic material as claimed in claim 44, wherein the packet is prepared by complex coacervation of gelatin.

46. A heat-developable diffusion transfer color photographic material as claimed in claim 1, wherein the color photographic material further comprises a reducing agent.

47. A heat-developable diffusion transfer color photographic material as claimed in claim 46, wherein the reducing agent is a compound which is oxidized by the organic silver salt oxidizing agent to form an oxidized product capable of reacting with the color image forming substance.

48. A heat-developable diffusion transfer color photographic material as claimed in claim 46, wherein the reducing agent is selected from the group consisting of a p-phenylene diamine type color developing agent, an amino phenol compound, a sulfonamidophenol compound, an aminonaphthol compound, a sulfonamidonaphthol compound, an aminohydroxy pyrazole compound, an aminopyrazoline compound and a hydrazone compound.

49. A heat-developable diffusion transfer color photographic material as claimed in claim 1, wherein the color photographic material further comprises an auxiliary developing agent.

50. A heat-developable diffusion transfer color photographic material as claimed in claim 46, wherein the reducing agent is present in an amount of from 0.1 mol to 20 mols per mol of the oxidizing agent.

51. A heat-developable diffusion transfer color photographic material as claimed in claim 1, wherein the color photographic material further comprises a base or a base releasing agent.

52. A heat-developable diffusion transfer color photographic material as claimed in claim 51, wherein the base releasing agent is a salt of a carboxylic acid and an organic base.

53. A heat-developable diffusion transfer color photographic material as claimed in claim 51, wherein the base releasing agent is guanidine trichloroacetate.

54. A heat-developable diffusion transfer color photographic material as claimed in claim 1, wherein the color photographic material further comprises a compound which activates development and simultaneously stabilizes the image formed.

55. A heat-developable diffusion transfer color photographic material as claimed in claim 54, wherein the compound which activates development and simultaneously stabilizes the image formed is an isothiuronium.

56. A heat-developable diffusion transfer color photographic material as claimed in claim 54, wherein the compound which activates development and simultaneously stabilizes the image formed is present in an amount in a range of from 1/100 time to 10 times by molar ratio based on silver.

57. A heat-developable diffusion transfer color photographic material as claimed in claim 1, wherein the image receiving element contains a dye mordant.

58. A heat-developable diffusion transfer color photographic material as claimed in claim 1, wherein the image receiving element comprises an image receiving layer containing a polymer mordant.

59. A heat-developable diffusion transfer color photographic material as claimed in claim 44, wherein the light-sensitive silver halide is spectrally sensitized.

60. A heat-developable diffusion transfer color photographic material as claimed in claim 59, wherein each of a combination of a blue-sensitive silver halide emulsion and a yellow color image forming substance, a combination of a green-sensitive silver halide emulsion and a magenta color image forming substance, and a combination of a red-sensitive silver halide emulsion and a cyan color image forming substance is incorporated into a separate packet emulsion.

61. A method of forming a color image comprising the steps of: imagewise exposing a heat-developable diffusion transfer color photographic material comprising a heat-developable color photographic element containing a light-sensitive silver halide, an organic silver salt oxidizing agent and a color image forming substance containing a color image forming dye which does not contain a group having a charge and an image receiving element capable of accepting a dye which is formed or released in the heat-developable color photographic element, the heat-developable color photographic element and the image receiving element being provided on a support having further provided thereon a microcapsule comprising a water-immiscible compound which is liquid at a temperature of not less than 120° C. as a core material and a water-insoluble polymer wall; and heating the exposed material at a temperature of from 80° C. to 250° C., wherein the color image forming substance is a compound containing a dye selected from the group consisting of an azo dye, an azomethane dye, an anthraquinone dye, a naphthoquinone dye, a nitro dye, a styryl dye, a quinophthalone dye, a triarylmethane dye, a phthalocyanine dye and a precursor thereof.

62. A method of forming a color image as claimed in claim 61, wherein the heat-developable diffusion transfer color photographic material is heated at a temperature of from 120° C. to 190° C.

63. A method of forming a color image as claimed in claim 61, wherein the heat-developable diffusion transfer color photographic material is heated for from 0.5 sec. to 120 sec.

64. A method of forming a color image comprising the steps of: imagewise exposing a heat-developable color photographic element containing a light-sensitive silver halide, an organic silver salt oxidizing agent and a color image forming substance containing a color image forming dye which does not contain a group having a charge; and heating the exposed material at a temperature of from 80° C. to 250° C. superposed on an image receiving element capable of accepting a dye which is formed or released in the photographic element to diffusion transfer the dye to the image receiving element, in the presence of a microcapsule comprising a water-immiscible compound which is liquid at a temperature of not less than 120° C. as a core material and a water-insoluble polymer wall in at least one of the photographic element and the image receiving element, wherein the color image forming substance is a compound containing a dye selected from the group consisting of an azo dye, an azomethane dye, an anthraquinone dye, a naphthoquinone dye, a nitro dye, a styryl dye, a quinophthalone dye, a triarylmethane dye, a phthalocyanine dye and a precursor thereof.

* * * * *